US006828089B2

(12) United States Patent
Mifune

(10) Patent No.: US 6,828,089 B2
(45) Date of Patent: Dec. 7, 2004

(54) SILVER HALIDE PHOTOGRAPHIC EMULSION AND THERMALLY DEVELOPABLE PHOTOSENSITIVE MATERIAL

(75) Inventor: Hiroyuki Mifune, Kanagawa (JP)

(73) Assignee: Fuji Photo Film Co., LTD, Kanagawa (JP)

( * ) Notice: Subject to any disclaimer, the term of this patent is extended or adjusted under 35 U.S.C. 154(b) by 0 days.

(21) Appl. No.: 10/400,496

(22) Filed: Mar. 28, 2003

(65) Prior Publication Data

US 2004/0018457 A1 Jan. 29, 2004

(30) Foreign Application Priority Data

Apr. 2, 2002 (JP) ..... 2002-099887
Jun. 3, 2002 (JP) ..... 2002-161936

(51) Int. Cl.[7] ..... G03C 1/005; G03C 1/494

(52) U.S. Cl. ..... 430/568; 430/567; 430/599; 430/600; 430/603; 430/604; 430/605; 430/964

(58) Field of Search ..... 430/567, 568, 430/599, 600, 603, 604, 605, 964

(56) References Cited

U.S. PATENT DOCUMENTS 5,266,457 A * 11/1993 Kojima et al. ..... 430/603
5,273,874 A * 12/1993 Kojima et al. ..... 430/600
6,143,488 A * 11/2000 Uytterhoeven et al. ..... 430/600

OTHER PUBLICATIONS

"A Photographic Emulsion of Invariant Response with Wavelength", G.C. Farnell et al, The Journal of Photographic Science, vol. 22, 1974, pp 228–234.

"Factors Influencing the Response of Silver Iodide Emulsions", R.L. Jenkins et al, The Journal of Photographic Science, vol. 28, 1980, pp. 163–167.

* cited by examiner

*Primary Examiner*—Geraldine Letscher
(74) *Attorney, Agent, or Firm*—Taiyo, Nakajima & Kato

(57) ABSTRACT

This invention relates to a silver halide photographic emulsion in which a silver emulsion high in silver iodide content of 80% by mol to 100% by mol based on the silver iodide content is chemically sensitized by at least one of methods of chalcogen sensitization and gold sensitization under the conditions that pAg is from 1.5 to 7.0, as well as a thermally developable photosensitive material having at least one image forming layer containing at least a non-photosensitive organic silver salt, a photosensitive silver halide, a reducing agent and a binder on a support, and having at least one non-image recording protection layer to the image forming layer on the side remote from the support, and exposed by a laser beam in which the material contains the silver emulsion high in silver iodide content.

17 Claims, No Drawings

SILVER HALIDE PHOTOGRAPHIC EMULSION AND THERMALLY DEVELOPABLE PHOTOSENSITIVE MATERIAL

BACKGROUND OF THE INVENTION

1. Field of the Invention

The present invention concerns a silver halide photographic emulsion. Particularly, it relates to a silver halide photographic emulsion high in silver iodide content and having improved sensitivity and improved shelf stability as well as improved sensitivity to short time exposure, by controlled chemical sensitization. It further relates to a thermally developable photosensitive material using an emulsion with high silver iodide content, which has improved properties due to a novel chemical sensitization method.

2. Description of the Related Art

In recent years, a demand for improvements of sensitivity, shelf stability, development progress characteristics, gradation, graininess and sharpness of siliver halide photographic photosensitive material has been increased more and more. Silver halide emulsions are usually subjected to chemical sensitization by using various kinds of chemical substances in order to obtain desired sensitivity and gradation. Specifically, the method of chemical sensitization include chalcogen sensitization such as sulfur sensitization, selenium sensitization and tellurium sensitization, noble metal sensitization using noble metals such as gold and reduction sensitization by using a reducing agent or a reductive atmosphere. Each of these methods may be used alone or in combination with others. While various chemical sensitization methods have been reported for silver iodo bromide emulsions in which the silver iodide content is as low as 40% or less and the silver chloride emulsions, there are few concrete knowledge so far of effective chemical sensitization methods for photographic emulsions high in silver iodide content with the silver iodide content in a range from 80% to 100%.

In Journal of Photographic Science, vol. 8, p 118, issued in 1960, it was reported that sensitization of silver iodide grains by sulfur sensitization was difficult. Subsequently, it was reported in Journal of Photographic Science, vol. 22, p 228, issued in 1974 or vol. 28, p 163, issued in 1980 that the silver iodide emulsion was sensitized by sulfur sensitization at pAg of 7.5. It was also reported that sensitization was conducted by epitaxial formation in U.S. Pat. Nos. 4,459,353 and 4,142,900. However, it was difficult in the photographic emulsions high in silver halide content to improve the properties such as sensitivity or development performance to a practically useful level even by using the means described above.

In recent years, dry photographic processing has been demanded keenly in the medical field or in the field of print making with a view point of environmental preservation and space saving. In the fields described above, digitalization has been developed. Systems has widely spread in the field, in which an image information is inputted into computers, stored and then processed, if necessary, outputted on a photosensitive material by a laser image setter or a laser imager, at a place where the image is required, through communication device, and converted to a real image by development at the same place. The photosensitive material is required to be capable of recording with high-illumination laser exposure and required to give a sharp black image high in resolution and definition. As the digital imaging recording materials, various types of hard copy systems utilizing pigments and dyes such as ink jet printers and electrophotography have been used as general image forming systems. However, they are unsatisfactory in point of the image quality (sharpness, graininess, gradation and tone), which decides the diagnostic performance as in medical images, and the recording speed (sensitivity). Hence, they have not reached a level capable of replacing existent wet process silver salt films for medical use.

On the other hand, thermal image forming systems utilizing organic silver salts are described, for example, in the specifications of U.S. Pat. Nos. 3,152,904 and 3,457,075, and "Thermally Processed Silver Systems" by B. Shely (Imaging Processes and materials, Neblette, 8th edition, edited by Sturge, V. Walworth, and A. Shepp, page 2, 1996). Particularly, thermally developable photosensitive materials generally have a photosensitive layer in which a photosensitive silver halide, a reducing agent, a silver salt capable of reduction (for example, organic silver salt) and optionally, a toning agent for controlling the tone of silver dispersed in a matrix of a binder.

The thermally developable photosensitive material is heated to a high temperature (for example, 80° C. or higher) after imagewise exposure. Then a black silver image is formed on the thermally developable photosensitive material by oxidation/reduction reaction between a reducible silver halide or a reducible silver salt, which function as oxidizers, and a reducing agent. The oxidation/reduction reaction is promoted by a catalytic effect of latent images of a silver halide formed by the exposure. As a result, a black silver image is formed in an exposed region. The thermally developable photosensitive materials are disclosed in many literatures including U.S. Pat. No. 2,910,377 and JP-B No. 43-4924. Further, Fuji Medical Dry Imager-FM-DPL has been marketed practically as an image forming system for medical use.

Since the image forming systems utilizing the organic silver salt described above have no fixing step, the shelf stability of the image after the development, particularly worsening of a printout when exposed to light, cause a significant problem. As a method of improving the printout, a method of utilizing silver iodide formed by conversion of an organic silver salt was disclosed in U.S. Pat. No. 6,143,488 and EP 0922995. However, only insufficient sensitivity could be obtained by the method of converting the organic silver salt with iodine as disclosed therein, and it was difficult to set up an actual system. In addition, sensitive materials utilizing silver halide are described in WO97-48014, WO48015, U.S. Pat. No. 6,165,705, JP-A No. 8-297345 and JP No. 2785129. However, only insufficient levels of sensitivity and fogging could be attained and none of them could endure the practical use as the sensitive material for laser exposure.

SUMMARY OF THE INVENTION

The purpose of the present invention is to provide a photographic emulsion high in silver iodide content, which has high sensitivity and excellent shelf stability. The second purpose of the invention is to provide a thermally developable photosensitive material having high sensitivity and low $D_{min}$ and high $D_{max}$, and also excellent in shelf stability of image to the light after development.

The foregoing purposes of the present invention can be attained by the following silver halide photographic emulsion and the thermally developable photosensitive material according to the present invention described below.

A silver halide photographic emulsion containing silver iodide in an amount of 80% by mol to 100% by mol and chemically sensitized by at least one of a chalcogen sensitization method and a gold sensitization method at pAg of 1.5 to 7.0 range.

A thermally developable photosensitive material containing at least one kind of a photosensitive silver halide, non-photosensitive organic silver salt, a reducing agent and a binder on one surface of a support in which the photosensitive silver halide contains silver iodide in an amount of 80% by mol to 100% by mol and chemically sensitized by at least one of a chalcogen sensitization method and a gold sensitization method at pAg of 1.5 to 7.0 range.

The thermally developable photosensitive material as described above in which the photosensitive silver halide contains silver iodide in an amount of 90% by mol to 100% by mol.

The thermally developable photosensitive material as described above in which the grain size of the photosensitive silver halide is from 10 nm to 45 nm.

The thermally developable photosensitive material as described above in which the photosensitive silver halide is contained by 1 mol to 7 mol based on 1 mol of the non-photosensitive organic silver salt.

The thermally developable photosensitive material as described above, wherein the grains are formed under a condition in which the organic silver salt is not present and the photosensitive silver halide emulsion is chemically sensitized.

The high silver iodide photographic emulsion as described above, chemically synthesized by at least one of the chalcogen sensitization method and the gold sensitization method under the condition in which pAg is 6.5 or less, preferably, 6.0 or less, further preferably, 5.5 or less and is 1.5 or more, preferably, 2.0 or more and, further preferably, 2.5 or more.

The silver halide photographic emulsion as described above in which the chalcogen sensitization is selected from tellurium sensitization, selenium sensitization and sulfur sensitization, preferably from tellurium sensitization and selenium sensitization and, further preferably, is tellurium sensitization.

The silver halide photographic emulsion as described above in which the gold sensitization is gold/chalcogen sensitization, which is a combination of gold sensitization and chalcogen sensitization, wherein the gold/chalcogen sensitization is selected from the group consisting of gold/sulfur sensitization, gold/selenium sensitization, gold/tellurium sensitization, gold/sulfur/selenium sensitization, gold/sulfur/tellurium sensitization, gold/selenium/tellurium sensitization, and gold/sulfur/tellurium sensitization.

The silver halide photographic emulsion as described above further subjected to reduction sensitization in addition to the chalcogen sensitization and gold sensitization.

The silver halide photographic emulsion as described above in which the photosensitive silver halide grains have an epitaxially formed portion, which portion preferably contains silver bromide and silver chloride.

The silver halide photographic emulsion as described above in which the photosensitive silver halide grains contain dislocation lines or lattice defects.

The silver halide photographic emulsion as described above in which the grain size of the photosensitive silver halide grains is 0.5 $\mu$m or less, preferably, 0.1 $\mu$m or less and, further preferably, 0.05 $\mu$m or less, and is 0.005 $\mu$m or more, and the coefficient of variation of the grain size is 30% or less, preferably, 25% or less and, particularly preferably, 20% or less.

The silver halide photographic emulsion as described above in which the photosensitive silver halide grains contain group VIII metals, for example, Fe, Ir, Ru, Rh and Os, and organic or inorganic four- to six-coordinate complexes thereof.

The silver halide photographic emulsion as described above in which the photosensitive silver halide emulsion contains a sensitizing dye, preferably, a cyanine dye or a merocyanine dye.

The silver halide photographic emulsion as described above in which the photosensitive silver halide emulsion contains compounds described in U.S. Pat. Nos. 5,413,905, 5,482,825, 5,747,235, 5,747,236, 5,994,051, and 6,054,260.

The thermally developable photosensitive material as described above in which the photosensitive silver halide emulsion is the silver halide photographic emulsion as described above.

The silver halide photographic emulsion and the thermally developable photosensitive material as described above which are exposed by a laser beam.

The thermally developable photosensitive material as described above in which the peak wavelength of the laser beam is in a range from 600 nm to 900 nm.

The thermally developable photosensitive material as described above in which the peak wavelength of the laser beam is in a range from 300 nm to 500 nm.

According to a first feature, the invention provides a silver halide photographic emulsion (A) containing silver iodide in an amount of 80% by mol to 100% by mol and chemically sensitized by at least one of methods of a chalcogen sensitization method, or a gold sensitization method under the condition in which pAg is in a range from 1.5 to 7.0.

According to a second feature, the invention provides a silver halide photographic emulsion, wherein the photosensitive silver halide contains silver iodide in an amount of 90% by mol to 100% by mol and chemically sensitized by at least one of methods of a chalcogen sensitization method, or a gold sensitization method under the condition in which pAg is in a range from 1.5 to 7.0.

According to a third feature, the invention provides a silver halide photographic emulsion, wherein a grain size of the silver halide in the silver halide photographic emulsion (A) is in a range from 5 nm to 70 nm.

According to a fourth feature, the invention provides a silver halide photographic emulsion, wherein the grains of the photosensitive silver halide in the silver halide photographic emulsion (A) are formed under the condition that a non-photosensitive organic silver salt is not present and chemically sensitized.

According to a fifth feature, the invention provides a silver halide photographic emulsion, wherein the silver halide photographic emulsion (A) is chemically sensitized by at least one of methods of chalcogen sensitizing method and gold sensitizing method under the condition in which pAg is in a range from 1.5 to 6.5.

According to a sixth feature, the invention provides a silver halide photographic emulsion, wherein the chalcogen sensitization applied to the silver halide photographic emulsion (A) is selected from tellurium sensitization, selenium sensitization and sulfur sensitization.

According to a seventh feature, the invention provides a silver halide photographic emulsion, wherein the gold sensitization applied to the silver halide photographic emulsion (A) is gold chalcogen sensitization, which is a combination of gold chalcogen sensitization and chalcogen sensitization, including gold/sulfur sensitization, gold/tellurium sensitization, gold/sulfur/selenium sensitization, gold/sulfur/tellurium sensitization, gold/selenium/tellurium sensitization, and gold/sulfur/tellurium sensitization.

According to a eighth feature, the invention provides a silver halide photographic emulsion, wherein reduction sensitization is further applied in silver halide photographic emulsion (A) in addition to the chalcogen sensitization or gold sensitization.

According to a ninth feature, the invention provides a silver halide photographic emulsion, wherein the silver halide photographic emulsion (A) is exposed by a laser beam.

According to a 10th feature, the invention provides a thermally developable photosensitive material (B) having, disposed on it, at least one image forming layer containing at least one kind of a photosensitive silver halide, a non-photosensitive organic silver salt, a reducing agent and a binder on one surface of a support, wherein the photosensitive silver halide contains 80% by mol to 100% by mol based on silver iodide, and chemically sensitized by at least one of methods of a chalcogen sensitization method and a gold sensitization method under the condition in which pAg is in a range from 1.5 to 7.0.

According to a 11th feature, the invention provides a thermally developable photosensitive material having, disposed on it, at least one image forming layer containing at least one kind of a photosensitive silver halide, a non-photosensitive organic silver salt, a reducing agent and a binder on one surface of a support, wherein the photosensitive silver halide contains 90% by mol to 100% by mol based on silver iodide, and chemically sensitized by at least one of methods of a chalcogen sensitization method and a gold sensitization method under the condition in which pAg is in a range from 1.5 to 7.0.

According to a 12th feature, the invention provides a thermally developable photosensitive material, wherein the grain size of the silver halide in the thermally developable photosensitive material (B) is in a range from 5 nm to 70 nm.

According to a 13th feature, the invention provides a thermally developable photosensitive material, wherein the coating amount of the photosensitive silver halide grains in the thermally developable photosensitive material (B) is in a range from 0.5% by mol to 15% by mol based on 1 mol of a non-photosensitive organic silver salt.

According to a 14th feature the invention provides a thermally developable photosensitive material, wherein the grains of the photosensitive silver halide in the thermally developable photosensitive material (B) are formed under the condition that the non-photosensitive organic silver salt is not present, and chemically sensitized.

According to a 15th feature, the invention provides a thermally developable photosensitive material, wherein the thermally developable photosensitive material (B) is chemically sensitized by at least one of methods selected from chalcogen sensitizing method and gold sensitizing method under the condition in which pAg is in a range from 1.5 to 6.5.

According to a 16th feature, the invention provides a thermally developable photosensitive material, wherein the chalcogen sensitization applied to the thermally developable photosensitive material (B) is selected from tellurium sensitization, selenium sensitization and sulfur sensitization.

According to a 17th feature, the invention provides a thermally developable photosensitive material, wherein the gold sensitization applied to the thermally developable photosensitive material (B) is gold chalcogen sensitization, which is a combination of gold sensitization and chalcogen sensitization, including gold/sulfur sensitization, gold/tellurium sensitization, gold/sulfur/selenium sensitization, gold/sulfur/tellurium sensitization, gold/selenium/tellurium sensitization, gold/sulfur/tellurium sensitization.

According to a 18th feature, the invention provides a thermally developable photosensitive material, wherein reduction sensitization is further applied to the thermally developable photosensitive material (B) in addition to the chalcogen sensitization and the gold sensitization.

According to a 19th feature, the invention provides a thermally developable photosensitive material, wherein the thermally developable photosensitive material (B) is exposed by a laser beam.

DESCRIPTION OF THE PREFERABLE EMBODIMENTS

Hereinafter the present invention will be described specifically.

1. Silver Halide Photographic Emulsion

The photosensitive silver halide photographic emulsion recited in the invention is a silver emulsion high in silver iodide content having a silver iodide content in a range from 80% by mol to 100% by mol. According to the invention, the emulsion is chemically sensitized by at least one of a chalcogen sensitization method and a gold sensitization method under the conditions in which pAg is 7.0 or less, preferably, 6.5 or less, more preferably, 6.0 or less and, particularly preferably, 5.5 or less and is 1.5 or more, preferably, 2.0 or more and, particularly preferably, 2.5 or more.

1-1. Chemical Sensitization

1) Chalcogen Sensitization Method

The chalcogen sensitization method can include a sulfur sensitization method, a selenium sensitization method and a tellurium sensitization method.

(Sulfur Sensitization)

In the sulfur sensitization, unstable sulfur compounds can be used. Unstable sulfur compounds described, for example, in Chimie et Physique Photographique, written by P. Grafkides (published from Paul Momtel Co. in 1987, 5th edition), and Journal of Research Disclosure, vol. 307, No. 307105 can be used.

Specifically, known sulfur compounds such as thiosulfates (for example, hypo), thiourea (for example, diphenyl thiourea, triethyl thiourea, N-ethyl-N'-(4-methyl-2-thiazolyl) thiourea, carboxymethyl trimethyl thiourea), thioamides (for example, thioacetoamide), rhodanines (for example, diethyl rhodanine and 5-benzylidene-N-ethylrhodanine), phosphine sulfides (for example, trimethyl phosphine sulfide), thiohydantoins, 4-oxo-oxazolyzine-2-thiones, disulfides or polysulfides (for example, dimorpholine disulfide, cystine, hexathiocane-thion), mercapto compound (for example, cystein), polythionates and elemental sulfur, as well as active gelatin can also be used. Particularly, thiosulfates and thioureas and rhodanines are preferable.

(Selenium Sensitization)

In the selenium sensitization, unstable selenium compounds are used and selenium compounds described, for example, in JP-B Nos. 43-13489, and 44-15748, JP-A Nos. 4-25832, 4-109340, 4-271341, 5-40324, 5-11385, Japanese Patent Application Nos. 4-202415, 4-330495, 4-333030, 5-4203, 5-4204, 5-106977, 5-236538, 5-241642, and 5-286916 can be used.

Specifically, colloidal metallic selenium, selenoureas (for example, N,N-dimethyl selenourea, trifluoromethylcarbonyl-trimethyl selenourea and acetyltrimethyl selenourea), selonoamides (for example, selenoamide, N,N-diethylphenyl selenoamide), phosphine selenides (for example, triphenyl phosphine selenide, pentafluorophenyl triphenylphospnine selenide), selenophosphates (for example, tri-p-tolylselenophosphate, and tri-n-butylselenophosphate), selenoketones (for example, seleno benzophenone), isoselenocyanates, selenocarboxylic acids, seleno esters and diacylselenides may be used. Further, unstable selenium compounds as described, for example, in JP-B Nos. 46-4553 and 52-34492, such as selenious acid, selenocyanate, selenazoles and selenides can also be used. Particularly, phosphine selenides, selenoureas and selenocyanates are preferable.

(Tellurium Sensitization)

In the tellurium sensitization, unstable tellurium compounds are used and unstable tellurium compounds described, for example, in JP-A Nos. 4-2245595, 4-271341, 4-333043, 5-303157, 6-27573, 6-175258, 6-180478, 6-208186, 6-208184, 6-317867, 7-140579, 7-301879 and 7-301880 may be used.

Specifically, phosphinetellurides, (for example, butyldiisopropyl phosphinetelluride, tributyl phosphinetelluride, tributoxyphosphine telluride, ethoxy-diphenylphosphine telluride), diacyl(di)tellurides (for example, bis(diphenylcarbamoyl)ditelluride, bis(N-phenyl-N-methylcarbamoyl) ditelluride, bis(N-phenyl-N-methylcarbamoyl)telluride, bis(N-phenyl-N-benzylcarbamoyl)telluride, bis(ethoxycarbonyl)telluride), telluroureas (for example, N,N'-dimethylethylene tellulourea, N,N'-diphenylethylene tellurourea), telluroamides, and telluro esters may be used. Particularly, diacyl(di)tellurides and phosphinetellurides are preferable and, particularly, compounds described in the literature cited in JP-A No. 11-65021 at column No. 0030 and compounds represented by the general formulae (II), (III), and (IV) in JP-A No. 5-313284 are more preferable.

Particularly, according to the invention, selenium sensitization and tellurium sensitization are preferable and tellurium sensitization is particularly preferable.

2) Gold Sensitization Method

In the gold sensitization, gold sensitizers described in Chimie et Physique Photographique, written by P. Grafkides (published from Paul Momtel Co. in 1987, 5th edition), and Journal of Research Disclosure, vol. 307, No. 307105 can be used. Specifically, chloroauric acid, potassium chloroaurate, potassium aurithiocyanate, silver sulfide and sulfur selenide can be used and, in addition, gold compounds described, for example, in U.S. Pat. Nos. 2,642,361, 5,049,484, 5,049,485, 5,169,751, 5,252,455, and Belgium Patent No. 691857 can also be used. Further, salts of noble metal other than gold such as of platinum, palladium and iridium described in Chimie et Physique Photographique, written by P. Grafkides (published from Paul Momtel Co. in 1987, 5th edition), and Journal of Research Disclosure, vol. 307, No. 307105 can also be used.

While gold sensitization can be applied solely, it is used preferably in combination with the chalcogen sensitization. Specifically, the combined sensitization methods can be gold/sulfur sensitization, gold/selenium sensitization, gold/tellurium sensitization, gold/sulfur/selenium sensitization, gold/sulfur/tellurium sensitization, gold/selenium/tellurium sensitization, and gold/sulfur/selenium/tellurium sensitization.

3) Chemical Sensitization Process

In the invention, the chemical sensitization can be conducted at any time after formation of grains and before coating, and it can include a time after desalting (1) before spectral sensitization, (2) simultaneously with spectral sensitization, (3) after spectral sensitization, and (4) just before coating.

4) Amount of Chemical Sensitizer Used

An amount of the chalcogen sensitizer such as sulfur, selenium and tellurium used according to the invention varies depending on silver halide grains used and a chemical ripening conditions, and it can be in a range from $10^{-8}$ mol to $10^{-1}$ mol, preferably, from $10^{-7}$ mol to $10^{-2}$ mol per one mol of the silver halide.

In the same manner, an addition amount of the gold sensitizer used according to the invention differs depending on various conditions. It is, generally, in a range from $10^{-7}$ to $10^{-2}$ mol, more preferably, from $10^{-6}$ to $10^{-3}$ mol per 1 mol of the silver halide.

5) Condition for Chemical Sensitization

There is no particular restrictions on the conditions for the chemical sensitization according to the invention except for a condition of pAg. The pH can be in a range from 3 to 10 and, preferably, from 4 to 9, and the temperature is in a range from 20° C. to 95° C., and, preferably, from 25° C. to 80° C.

As described above, it has been known to conduct sulfur sensitization for the silver iodide emulsion under the condition in which pAg is 7.5, as disclosed for example, in Journal of Photographic Science, vol. 22, p. 228, issued in 1974. However, there has been no suggestion at all that the sensitivity is extremely increased and, further, the shelf stability is improved remarkably under the condition that pAg is further lowered, particularly, to 7.0 or less as shown in the example of the present invention. It is considered that the improvements are caused because a reaction rate of the sulfur sensitizer and the like is extremely small and most of them remain in the emulsion without reacting as the pAg of the emulsion is 7.5 as shown in the examples described later, however there is an unexpected abrupt change in which the reaction rate increases abruptly when the pAg is lowered to 7.0 or less, particularly, to 6.5 or less and most of the sulfur sensitizer react when the pAg is 6.0 or less. As a result, it is also expected that the amount of the sensitizer required for the optimal sensitization can be decreased according to the invention. The decrement may also contributes to the improvement of the shelf stability of the silver emulsion high in silver iodide content. These preferable results are not suggested at all in the known knowledge.

6) Reduction Sensitization

In the invention, in addition to the chalcogen sensitization or the gold sensitization, a reduction sensitization can also be applied in combination with them. It is preferably used in combination with the chalcogen sensitization.

As specific compounds for the reduction sensitization method, ascorbic acid, thiourea dioxide, and dimethylamine borane are preferable and, in addition, stannous chloride, aminoimino methane sulfinate, hydrazine derivatives, borane compounds, silane compounds and polyamine compounds are preferably used. The reduction sensitizer may be added at any process of the photosensitive emulsion production steps from a crystal growing step to a preparation step just before coating. Further, it is also preferable to conduct reduction sensitization by ripening the emulsion while keeping pH of the emulsion at 8 or more or while keeping the pAg at 4 or less. It is also preferable to conduct reduction sensitization by introducing the single addition portion of silver ions during formation of grains.

An addition amount of the reduction sensitizer is also different depending on various conditions and, generally, it is in a range from $10^{-7}$ to $10^{-1}$ mol, preferably, from $10^{-6}$ to $5\times10^{-2}$ mol per 1 mol of the silver halide.

In the silver halide emulsion recited in the invention, a thiosulfonic acid compound may be added by the method shown in EP-A No. 293,917.

It is necessary for designing a thermally developable photosensitive material with high sensitivity that the photosensitive silver halide grains recited in the invention are chemically sensitized by at least one of the gold sensitization method and the chalcogen sensitization method.

1-2. Silver Iodide Content

In the photosensitive silver halide recited in the invention, it is important that a silver iodide content is as high as 80% by mol or more and 100% by mol or less. There is no particular restrictions for the remaining portion and the remaining portion can be selected from silver chloride, silver bromide or organic silver salts such as silver thiocyanate or silver phosphates and it is particularly preferably silver bromide or silver chloride. By using the silver halide of the composition with high silver iodide content as described above, a favorable thermally developable photosensitive material having good image shelf stability after development, particularly, having remarkably small increase in the fogging by light irradiation can be designed. Further, the silver iodide content is preferably from 85% by mol to 100% by mol and, particularly, it is preferably from 90% by mol to 100% by mol in regard of the shelf stability of the image to the light irradiation after the development.

The halogen composition may be uniform, or the changing stepwise, changing continuously in the grain. Further, silver halide grains having core/shell structure can also be used preferably. Core/shell grains having 2 to 5 multi-layered structures are structurally preferable and core/shell grains having 2 to 4 layered structures can be more preferably used. High core silver iodide content structure in which the silver iodide content is higher in the core, or high shell silver iodide content structure in which the silver iodide content is higher in the shell can also be used preferably. Further, a technique of localizing silver chloride or silver bromide, which are made an epitaxial portion, on the surface of the grain can also be used preferably.

1-3. Silver Halide Grain Size

There is no particular restriction on the grain size of silver halide high in silver iodide content according to the invention. However it can be 0.5 $\mu$m or less, preferably, 0.1 $\mu$m or less and, particularly preferably, 0.05 $\mu$m or less. Further, when the grains recited in the invention are used for the thermally developable photosensitive material, the grain size is preferably in a range from 5 nm to 90 nm. When the size of silver halide is larger, the coating amount of silver halide necessary for attaining a required maximum density increases. The present inventor has found that, as to the silver halide of a composition high in silver iodide content, which is used preferably according to the invention, when the coating amount of the silver halide is large, development is suppressed remarkably to lower the sensitivity and worsen the density stability to the developing time undesirably and, accordingly, the maximum density can not be obtained within a predetermined developing time with the grain size larger than a predetermined level. On the other hand, it has been found that sufficient development performance is provided by restricting the addition amount even if the silver halide is silver iodide.

As described above, in a case of using silver iodide, the size of silver halide grains is required to be sufficiently small for attaining a sufficient maximum optical density. A preferable grain size of the silver halide is in a range from 5 nm to 70 nm and, further preferably, 5 nm to 55 nm. Particularly preferably, the grain size is in a range from 10 nm to 45 nm. The term "grain size" used herein means an average diameter when converted into a circular image occupying an area identical with the projection area observed by an electron microscope.

1-4. Coating Amount of Silver Halide

The coating amount of the silver halide grains is 0.5% by mol to 15% by mol, preferably, 0.5% by mol to 12% by mol and, further preferably, 0.5% by mol to 10% by mol based on 1 mol of silver in the non-photosensitive organic silver salt described later. It is, more preferably, 1% by mol to and 9% by mol and, particularly preferably, 1% by mol to 7% by mol. Selection of the addition amount is extremely important for suppressing the remarkable development inhibition by silver halide of the composition high in silver iodide content found by the present inventor.

1-5. Method of Forming Silver Halide Grains

The method of forming photosensitive silver halide is well known in the relevant field and, for example, methods described in Research Disclosure, June 1978, No, 17029 and U.S. Pat. No. 3,700,458 can be used. Specifically, a method, in which a silver supply compound and a halogen supply compound are added in gelatin or in other polymer solutions to prepare a photosensitive silver halide and thus-prepared photosensitive silver halide is mixed with an organic silver salt, is used. Further, a method described in JP-A No. 11-119374; column Nos. 0217 to 0224 and a method described in JP-A No. 11-352627 and Japanese Patent Application No. 2000-42336 are also preferable.

The shape of the silver halide grains can include, for example, cubes, octahedrons, plate grains, spherical grains, rod grains, and potato-like grains. The silver halide of a composition high in silver iodide content recited in the invention can take complicate shapes and preferable forms can include, for example, jointed grains as shown in Journal of Phot. Sci. Vol. 28 (1980), p 164—FIG. 1 by R. L. Jenkins, et al. Flat plate grains shown in FIG. 1 shown in the same are also used preferably. Silver halide grains having rounded corners can also be used preferably. While there is no particular restriction on the indices of a plane (mirror index) on the outer surface of the photosensitive silver halide grains, silver halide grains having high content ratio of [100] face, which gives high spectral sensitization efficiency when spectral sensitizing dyes are adsorbed on the face, are preferable. The content ratio is preferably 50% or more, more preferably, 65% or more and, further preferably, 80% or more. The content ratio of the mirror index [100] face can be determined by the method described in J. Imaging Sci., 29, 165 (1985) by T. Tani utilizing the adsorption dependence of [111] face and [ 100] face in the adsorption of the sensitizing dye.

1-6. Heavy Metal Ion

The photosensitive silver halide grain recited in the invention can contain metals belonging to group VIII to group X of the periodical table (showing groups from 1 to 18) or metal complexes thereof. The metal or the center metal of the metal complex belonging to the groups VIII to groups X of the periodical table is preferably rhodium, ruthenium and iridium. The metal complex may be used solely or two or more of homologous metal complexes and heterogeneous metal complexes may be used together. A preferable content is within a range from $1\times10^{-9}$ mol to $1\times10^{-3}$ mol based on one mol of silver. The heavy metals, metal complexes thereof and addition method of them are described in JP-A No. 7-225449, JP-A No. 11-65021, column; Nos. 0018 to 0024, JP-A Nos. 11-119374; column Nos. 0227 to 0240.

According to the invention, silver halide grains in which a hexacyanometal complex is present on the outermost surface of the grain is preferable. The hexacyanometal complex can include, for example, $[Fe(CN)_6]^{-4}$, $[Fe(CN)_6]^{-3}$, $[Ru(CN)_6]^{-4}$, $[Os(CN)_6]^{-4}$, $[Co(CN)_6]^{-3}$, $[Rh(CN)_6]^{-3}$, $[Ir(CN)_6]^{-3}$, $[Cr(CN)_6]^{-3}$, and $[Re(CN)_6]^{-3}$. According to the invention, hexacyano Fe complex is preferable.

Since the hexacyano metal complex is present in the form of ions in an aqueous solution, counter cation is not important, but the use of alkali metal ions such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra(n-butyl) ammonium ion), which are miscible with water and suitable to the precipitation operation of the silver halide emulsion, is preferable.

The hexacyano metal complex can be added in a form, in which the hexacyano metal complex is mixed with water or with a mixed solvent of water and an appropriate organic solvent miscible with water (for example, alcohols, ethers, glycols, ketones, esters and amides) or with gelatin.

The addition amount of the hexacyano metal complex is preferably in a range from $1\times10^{-5}$ mol to $1\times10^{-2}$ mol, more preferably, from $1\times10^{-4}$ mol to $1\times10^{-3}$ mol per 1 mol of silver.

For disposing the hexacyano metal complex on the outermost surface of silver halide grains, a method can be used, in which after addition of an aqueous solution of silver nitrate used for formation of grains, the hexacyano metal complex is directly added, before completion of the charging step prior to the chemical sensitization step of conducting chalcogen sensitization such as sulfur sensitization, selenium sensitization and tellurium sensitization or noble metal sensitization such as gold sensitization, or during water washing step, or during dispersion step or before the chemical sensitization step. In order not to grow the fine silver halide grains, the hexacyano metal complex is preferably added immediately after formation of grains and preferably before completion of the charging step.

Addition of the hexacyano metal complex may be started after the addition of 96% by mass, more preferably, after the addition of 98% by mass and, particularly preferably, after the addition of 99% by mass, of silver nitrate based on the total mass of silver nitrate which is added for the formation of grains.

When the hexacyano metal complex is added after the addition of the aqueous solution of silver nitrate just before the completion of the formation of grains, the hexacyano metal complex can be adsorbed on the outermost surface of the silver halide grains and most of them form a slightly soluble salt with silver ions on the surface of grains. Since the silver salt of the hexacyano iron (II) is a salt less soluble than AgI, re-dissolution by fine grains can be prevented and it becomes possible to form fine silver halide grains with small grain size.

Further, the metal atoms that can be incorporated to the silver halide grains recited in the invention, the desalting method and the chemical sensitization method of the silver halide emulsion are described in JP-A No. 11-84574; column Nos. 0046 to 0050, JP-A No. 11-65021; column Nos. 0025 to 0031 and JP-A No. 11-119374; column Nos. 0242 to 0250.

1-7. Gelatin

For gelatins contained in the photosensitive silver halide emulsion recited in the invention, various gelatins can be used. Low molecular weight gelatin with the, molecular weight of 500 to 60,000 range is used preferably for favorably maintaining the dispersed state of the photosensitive silver halide emulsion in a coating liquid containing an organic silver salt. The low molecular weight gelatin may be used upon formation of grains or upon dispersion after the desalting treatment. The low molecular weight gelatin is preferably used upon dispersion after the desalting treatment.

1-8. Spectral Sensitizing Dye

For the sensitizing dye recited in the invention, sensitizing dyes that can spectrally sensitize silver halide grains in a desired wavelength region when adsorbed on the silver halide grains and have spectral sensitivity suitable to spectral characteristic of an exposure light source, call be selected advantageously. The thermally developable photosensitive material recited in the invention is preferably spectrally sensitized so as to have a spectral sensitivity peak, particularly, in a wavelength region from 600 nm to 900 nm, or 300 nm to 500 nm. The sensitizing dye and the addition method are disclosed, in JP-A No. 11-65021; column Nos. 0103 to 0109, as compounds represented by the general formula (II) in JP-A No. 10-186572, as dyes represented by the general formula (I) and in column: 0106 of JP-A No. 11-119374, as dyes described in U.S. Pat. Nos. 5,510,236, 3,871,887; Example 5, dyes disclosed in JP-A No. 2-96131, JP-A No. 59-48753, and disclosed in EP No. 0803764A1; page 19, line 38 to page 20, line 35, Japanese Patent Application No. 2000-86865, Japanese Patent Application Nos. 2000-102560, and 2000-205399. The sensitizing dye may be used solely or in combination of two or more of them. According to the invention, the sensitizing dye can be added to the silver halide emulsion at any time from the formation of grains to the coating and, preferably added at the time from the desalting step to the coating and, more preferably added at the time from the desalting to the completion of chemical ripening.

The addition amount of the sensitizing dye in the invention can be a desirable amount corresponding to the sensitivity and the fogging property and it is preferably in a range from $10^{-6}$ mol to 1 mol and more preferably, from $10^{-4}$ to $10^{-1}$ based on one mol of the silver halide in the photosensitive layer.

According to the invention, a supersensitizer may be used for improving the spectral sensitizing efficiency. The supersensitizer used in the invention can include compounds as described in EP-A No. 587338, U.S. Pat. Nos. 3,877,943 and 4,873,184 and JP-A Nos. 5-341432, 11-109547 and 10-111543.

1-9. Combined Use of Silver Halide

The photosensitive silver halide emulsion in the thermally developable photosensitive material recited in the invention may be used solely or in combination of two or more of them (for example, those of different average grain sizes, different halogen compositions, different crystal habits and different conditions for chemical sensitization). Gradation can be controlled by using plural kinds of photosensitive silver halides of different sensitivity. As the technique concerned, techniques described in, for example, JP-A Nos. 57-119341, 53-106125, 47-3929, 48-55730, 46-5187, 50-73627 and 57-150841 can be cited. In regard of the difference of the sensitivity, a difference of 0.2 logE or more between each of the emulsions can preferably be provided.

1-10. Method of Mixing Silver Halide and Organic Silver Salt

Grains of the photosensitive silver halide recited in the invention are formed preferably under the condition that non-photosensitive organic silver salt is not present, and chemically sensitized. This is because a sufficient sensitivity can not sometimes be attained by the method of forming a silver halide by the addition of a halogenating agent to the organic silver salt.

The method of forming the silver halide under the condition in which the non-photosensitive organic silver salt is not present can include a method in which the photosensitive silver halide and the organic silver salt prepared separately are mixed by a high speed stirrer, ball mill, sand mill, colloid mill, vibration mill and homogenizer, a method in which the completely-prepared photosensitive silver halide is mixed with the organic silver salt at any time during the preparation of the organic silver and the organic silver salt is prepared, and the like. The effect of the invention can be obtained preferably by any of the methods.

The silver halide of the invention is added into the coating liquid for the image forming layer at a time preferably from 180 min before coating to immediately before coating and, preferably, 60 min before coating to 10 sec before coating. There are no particular restrictions on the mixing method and the mixing condition so long as the effect of the invention can be obtained sufficiently. The specific mixing method can include a method of mixing in a tank designed so as to provide a desired average staying time calculated from the addition flow rate and the delivery amount to the coater, or a method of using a static mixer described, for example, in "Liquid Mixing Technique", in Chapter 8, written by N. Harnby, M. F. Edwards, A. W. Nienow and translated by Koji Takahashi (published from Nikkan Kogyo Shinbunsha, 1989).

2. Thermally Developable Photosensitive Material

The thermally developable photosensitive material recited in the invention has, on one surface of a support, an imaging forming layer containing at least one kind of the photosensitive silver halide, a non-photosensitive organic silver salt, a reducing agent and a binder. Further, an intermediate layer and a surface protection layer may be present preferably on the image forming layer, or a back layer or a back protection layer may be present on the opposite surface of the support.

Constitutions for each of the layers and preferable ingredients thereof are described below specifically.

2-1. Image Forming Layer 2-1-1. Organic Silver Salt

The organic silver salt usable in the invention is a silver salt which is relatively stable to light and forms silver images when the organic salt is heated at 80° C. or higher and an exposed light catalyst (latent images of photosensitive silver halide, etc.) and a reducing agent are present. The organic silver salt may be any organic material containing a reducible silver ion source.

The non-photosensitive organic silver salt is described, for example, in JP-A No. 10-62899; column Nos. 0048 to 0049, EP No. 0803764A1; page 18, line 24 to page 19, line 37, EP No. 0962812A1, JP-A Nos. 11-349591, 2000-7683 and 2000-72711. Silver salts of organic acids are preferable and, particularly, silver salts of long chain aliphatic carboxylic acids (number of carbon atoms from 10 to 30, preferably, from 15 to 28) are particularly preferable.

Preferable examples of the organic silver salt can include silver behenate, silver arachidicate, silver stearate, silver oleate, silver laurate, silver caproate, silver myristate, silver palmitate and mixtures thereof. According to the invention, among the organic silver salts, an organic silver salt with the silver behenate content of 75% by mol or more is preferably used.

There are no particular restrictions on the shape of the organic silver salt recited in the invention. And needle-like shape, rod-like shape, plate-like shape, or scaly shape may be used. The needle-like shape and the scaly shape are preferable, and the scaly shape is particularly preferable.

The scaly organic silver salt is defined in the present invention as described below. An organic silver salt is observed by an electron microscope, the shape of the organic silver salt grains is approximated to a cuboid and, assuming the sides of the cuboid as a, b, c (from the shortest side to the largest side, c and b may be identical). And x is determined as described below by calculating from the shorter numerical values a, b.

$$x=b/a$$

Following the above-described calculation, x is determined for about 200 grains. And, assuming average value of them as x (average), those satisfying the relation: x (in average) $\geqq 1.5$ are defined as having the scaly shape. Preferably, x satisfies a relation, $30 \geqq x$ (average) $\geqq 1.5$, and, more preferably, $15 \geqq x$ (average) $\geqq 1.5$. The needle-like shape is defined as: $1 \leqq x$ (average) $\leqq 1.5$.

In the scaly grain, a can be regarded as a thickness of a plate-like shaped grain assuming a surface having b and c as sides as a main plane. An average of a is preferably in a range from 0.01 $\mu$m to 0.3 $\mu$m and, more preferably, from 0.1 $\mu$m to 0.23 $\mu$m. An average of c/b is, preferably, in a range from 1 to 6, more preferably, from 1 to 4, further preferably, from 1 to 3 and, particularly preferably, from 1 to 2.

The grain size distribution of the organic silver salt gives preferably a mono dispersion. In the mono dispersion, each of percentages of a values obtained by dividing the standard deviation for the length of the minor axis by the minor axis and by dividing the standard deviation for the length of the major axis by the major axis is preferably 100% or less, more preferably, 80% or less and, further preferably, 50% or less. The shape of the organic silver salt can be measured by a transmission type electron microscopic image of the organic silver salt dispersions. Another method of measuring the mono dispersibility is a method of determining the standard deviation of a volume-weighed average diameter of the organic silver salt, and the percentage (variation coefficient) of the value obtained by dividing the standard deviation of a volume-weighed average diameter by the volume-weighed average diameter is preferably 100% or less and, more preferably, 80% or less, further preferably, 50% or less.

As the measuring method, for example, the organic silver salt dispersed in a liquid can be measured by a laser beam scattering type grain size measuring device obtained commercially.

For the production and the dispersion method of the organic silver salt used in the invention, known methods can be applied. For example, JP-A No. 10-62899, EP Nos. 0803763A1, and 0962812A1, JP-A Nos. 11-349591, 2000-7683, and 2000-72711, Japanese Patent Application Nos. 11-348228 to 30, 11-203413, 2000-90093, 2000-195621, 2000-191226, 2000-213813, 2000-214155, and 2000-191226 can be cited as references.

When a photosensitive silver salt is present together upon dispersion of the organic silver salt, fogging increases to remarkably lower the sensitivity, hence it is more preferable that the photosensitive silver halide is not substantially contained during dispersion of the organic silver salt. According to the invention, the amount of the photosensitive silver salt contained in an aqueous dispersion of the organic silver salt to be dispersed is 0.1% by mol or less based on one mol of the organic acid silver salt in the liquid and it is desirable not to positively add the photosensitive silver salt.

While the organic silver salt recited in the invention can be used in a desired amount, the amount of silver is preferably in a range from 0.1 to 5.0 g/m$^2$, more preferably, from 1.0 to 3.0 g/m$^2$ and, further preferably, from 1.2 to 2.5 g/m$^2$.

2-1-2. Reducing Agent

The thermally developable photosensitive material of the invention contains a reducing agent for the organic silver salt. The reducing agent may be any material (preferably, organic material) that can reduce a silver ion to a metallic silver. Examples of the reducing agent are described in JP-A No. 11-65021; column Nos. 0043 to 0045 or EP No. 0803764, page 7, line 34 to page 18, line 12.

A preferable reducing agent recited in the invention is a so-called hindered phenol type reducing agent or bisphenol type reducing agent, having a substituent on the ortho-position to the phenolic hydroxyl group. Particularly, the compound represented by the following general formula (I) is preferable.

General Formula (I)

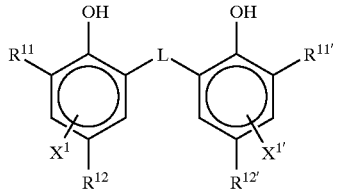

In the general formula (I) $R^{11}$ and $R^{11'}$ each independently represent an alkyl group having 1 to 20 carbon atoms. $R^{12}$ and $R^{12'}$ each independently represent represent a hydrogen atom or a substituent that can substitute a group on a benzene ring. L represents a group —S— or a group —$CHR^{13}$—. $R^{13}$ represents a hydrogen atom or an alkyl group having 1 to 20 carbon atoms. $X^1$ and $X^{1'}$ each independently represent a hydrogen atom or a group that can substitute a group on a benzene ring.

Hereinafter, each of the substituents is descried specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restrictions and can include, preferably, aryl group, hydroxyl group, alkoxy group, aryloxy group, alkylthio group, arylthio group, acylamino group, sulfonamide group, sulfonyl group, phosphoryl group, acyl group, carbamoyl group, ester group and halogen atom.

2) $R^{12}$ and $R^{12'}$ and $X^1$ and $X^{1'}$ $R^{12}$ and $R^{12'}$ each independently represent a hydrogen atom or a group that can substitute a group on a benzene ring, and $X^1$ and $X^{1'}$ each independently represent a hydrogen atom or a group that can substitute a group on a benzene ring. The groups for each of $R^{12}$, $R^{12'}$, $X^1$ and $X^{1'}$, that can substitute a group on a benzene ring can include, preferably, alkyl group, aryl group, halogen atom, alkoxy group and acylamino group.

3) L

L represents a —S— group or —$CHR^{13}$— group. $R^{13}$ represents a hydrogen atom or an alkyl group having 1 to 20 carbon atoms and the alkyl group may have a substituent.

Specific example of a non-substituted alkyl group for $R^{13}$ can include, for example, methyl group, ethyl group, propyl group, butyl group, heptyl group, undecyl group, isopropyl group, 1-ethylpentyl group, and 2,4,4-trimethylpentyl group.

Example of the substituent for the alkyl group are identical with the substituent group for $R^{11}$ and can include, for example, halogen atom, alkoxy group, alkylthio group, aryloxy group, arylthio group, acylamino group, sulfonamide group, sulfonyl group, phosphoryl group, oxycarbonyl group, carbamoyl group and sulfamoyl group.

4) Preferable Substituent $R^{11}$ and $R^{11'}$ are preferably secondary or tertiary alkyl group having 3 to 15 carbon atoms and can include, for example, isopropyl group, isobutyl group, t-butyl group, t-amyl group, t-octyl group, cyclohexyl group, cyclopentyl group, 1-methylcyclohexyl group, and 1-methylcyclopropyl group. $R^{11}$ and $R^{11'}$ are more preferably, tertiary alkyl group having 4 to 12 carbon atoms and, among them, t-butyl group, t-amyl group and 1-methylcyclohexyl group are further preferable and t-butyl group is most preferable.

$R^{12}$ and $R^{12'}$ include, preferably, alkyl groups having 1 to 20 carbon atoms and, specifically, can include methyl group, ethyl group, propyl group, butyl group, isopropyl group, t-butyl group, t-amyl group, cyclohexyl group, 1-methylcyclohexyl group, benzyl group, methoxymethyl group and methoxyethyl group. More preferably, they are methyl group, ethyl group, propyl group, isopropyl group, and t-butyl group.

$X^1$ and $X^{1'}$ include preferably hydrogen atom, halogen atom, and alkyl group and, more preferably, a hydrogen atom.

L is preferably a —$CHR^{13}$— group.

$R^{13}$ preferably includes a hydrogen atom or an alkyl group having 1 to 15 carbon atoms. The allyl group is preferably methyl group, ethyl group, propyl group, isopropyl group and 2,4,4-trimethylpentyl group. $R^{13}$ is particularly preferably a hydrogen atom, methyl group, propyl group or isopropyl group.

In a case where $R^{13}$ is a hydrogen atom, $R^{12}$ and $R^{12'}$ each preferably include alkyl group having 2 to 5 carbon atoms, and ethyl group and propyl group are more preferable and ethyl group is most preferable.

In a case where $R^{13}$ is a primary or secondary alkyl group having 1 to 8 carbon atoms, $R^{12}$ and $R^{12'}$ are preferably methyl group. As the primary or secondary alkyl group of 1 to 8 carbon atoms for $R^{13}$, methyl group, ethyl group, propyl group and isopropyl group are more preferable, and methyl group, ethyl group, and propyl group are further preferable.

In a case where each of the $R^{11}$, $R^{11'}$, $R^{12}$ and $R^{12'}$ is a methyl group, $R^{13}$ is preferably a secondary alkyl group. In this case, the secondary alkyl groups for $R^{13}$ are preferably isopropyl group, isobutyl group, and 1-ethylpentyl group, isopropyl group being more preferable.

The reducing agent is different in various thermal developing properties depending on the combination of $R^{11}$ and $R^{11'}$, $R^{12}$ and $R^{12'}$, and $R^{13}$. Since the thermal developing performances can be controlled by using two or more kinds of reducing agents at various mixing ratios, it is preferable to use two or more kinds of reducing agents in combination for some purposes.

Specific examples of the compounds represented by the general formula (I) recited in the invention are shown below but the invention is not restricted to them.

(I-1)
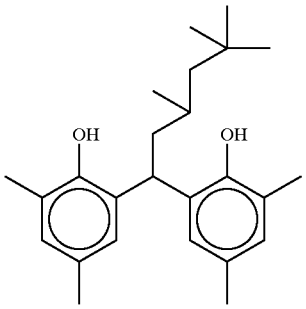
(I-2)
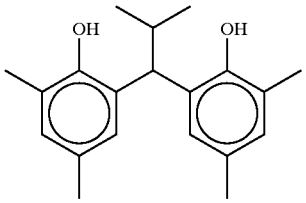
(I-3)
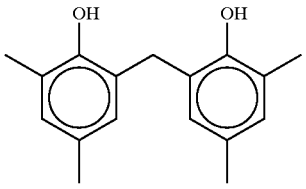
(I-4)
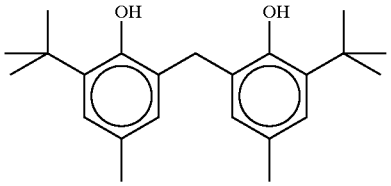
(I-5)
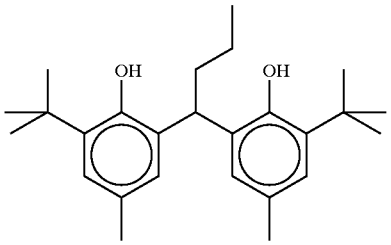
(I-6)
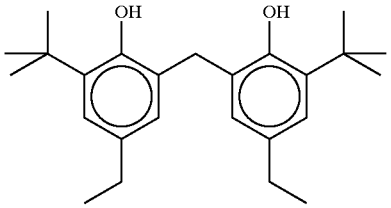
(I-7)
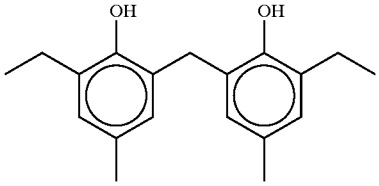
-continued
(I-8)
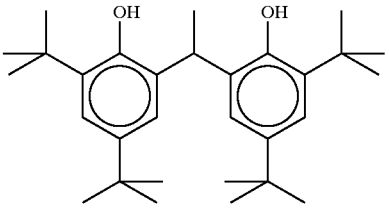
(I-9)
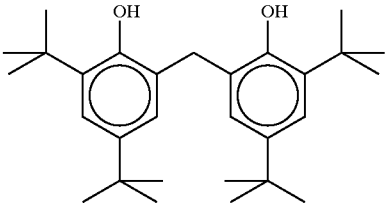
(I-10)
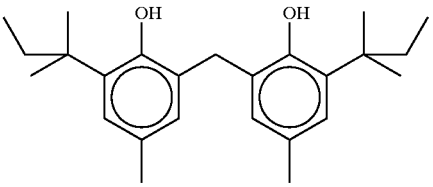
(I-11)
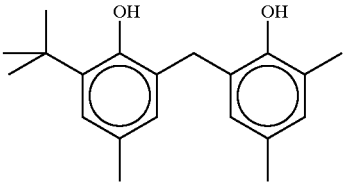
(I-12)
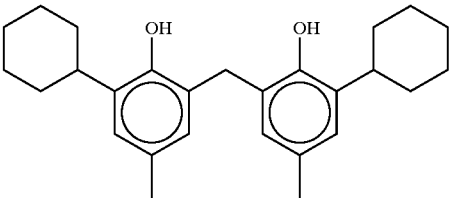
(I-13)
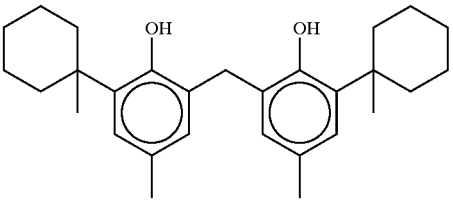
(I-14)
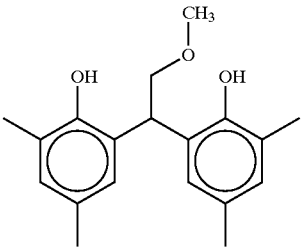

-continued (I-15)

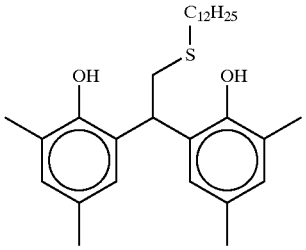

(I-16)

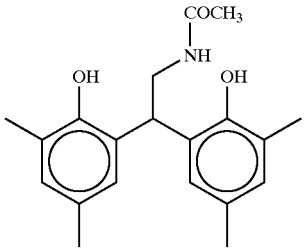

(I-17)

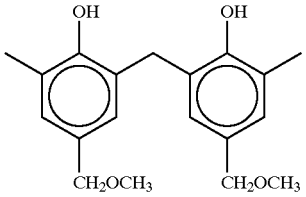

(I-18)

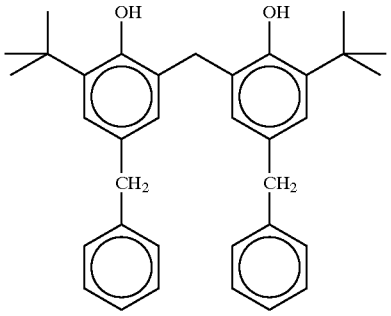

(I-19)

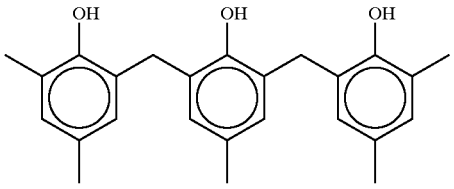

(I-20)

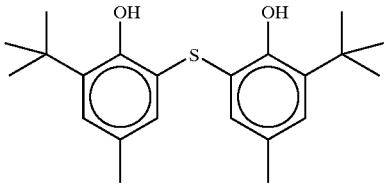

(I-21)

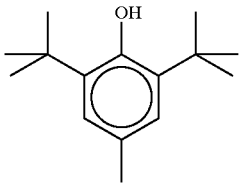

-continued (I-22)

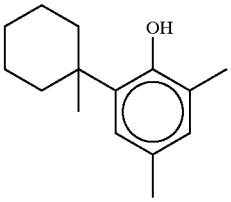

(I-23)

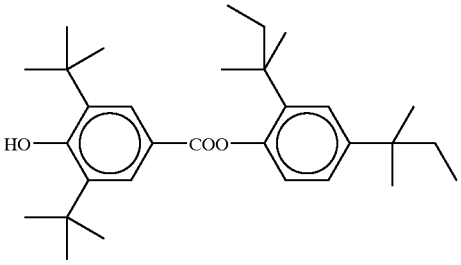

(I-24)

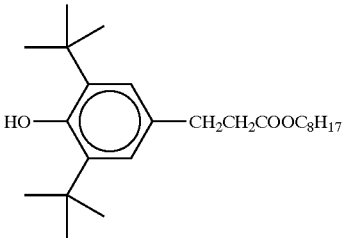

(I-25)

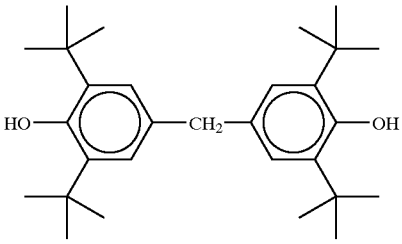

(I-26)

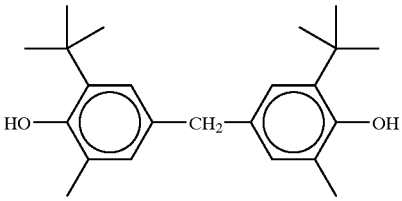

(I-27)

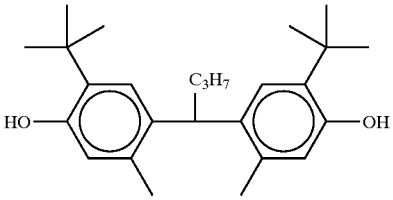

Compounds represented by (I-1) to (I-20) are particularly preferable.

The addition amount of the reducing agent in the invention is preferably from 0.01 to 5.0 g/m$^2$ and, more preferably, from 0.1 to 3.0 g/m$^2$. It is contained preferably in an amount of 5 to 50% by mol and, further preferably, from 10 to 40% by mol based on one mol of silver on the surface having the image forming layer.

The reducing agent of the invention can be added to the image forming layer containing the organic silver salt and the photosensitive silver halide, and to adjacent layers. More preferably it is contained in the image forming layer.

The reducing agent of the invention may be contained in the coating liquid by any method, for example, in the form of a solution, an emulsion dispersion and a fine solid grain dispersion, to be contained in the photosensitive material.

A well-known emulsifion dispersion method can include a method of dissolution using an oil such as dibutyl phthalate, tricresyl phosphate, glyceryl triacetate or diethyl phthalate and an auxiliary solvent such as ethyl acetate or cyclehexanone, to prepare the emulsified dispersion mechanically.

Further, the fine solid grain dispersion method can include a method in which a solid dispersion is prepared by dispersing a reducing agent in an appropriate solvent by a ball mill, colloid mill, vibration ball mill, sand mill, jet mill, roller mill or ultrasonic waves. A dispersion method using the sand mill is preferable. In this case, a protection colloid (for example, polyvinyl alcohol), surfactant (anionic surfactant, for example, sodium triisopropylnaphthalene sulfonate (a mixture of compounds each having three isopropyl group on different position)) may also be used. An antiseptic (for example, sodium benzoisothiazolinone) may be incorporated in an aqueous dispersion.

Particularly preferable is a solid grain dispersion method of the reducing agent and it is preferable to add fine grains with an average grain size of 0.01 $\mu$m to 10 $\mu$m range, preferably, 0.05 $\mu$m to 5 $\mu$m range and, more preferably, 0.1 $\mu$m to 2 $\mu$m range. According to the invention, it is preferable that other solid dispersion are used in which the grain size also within the range described above.

2-1-3. Development Accelerator

In the thermally developable photosensitive material recited in the invention, development accelerators such as sulfoneamide phenolic compounds represented by the general formula (A) described in JP-A Nos. 2000-267222 and 2000-330234, hindered phenolic compounds represented by the general formula (II) described in JP-A No. 2001-92075, hydrazine type compounds represented by the general formula (1) described in JP-A Nos. 10-62895 and 11-15116, and represented by the general formula (1) described in Japanese Patent Application No. 2001-074278, and phenolic or naphtholic compounds represented by the general formula (2) described in Japanese Patent Application No. 2000-76240 are preferably used. The development accelerator described above is used in an amount of 0.1 to 20% by mol and, more preferably, in an amount of 0.5 to 10% by mol and, more preferably, in an amount of 1 to 5% by mol based on the reducing agent. The introduction methods of the development accelerator to the sensitive material can include a similar method with that of the reducing agent. Addition in a form of a solid dispersion or emulsion dispersion is particularly preferable. In a case of addition in a form of the emulsion dispersion, it is preferable to add in a form of the emulsion dispersion by using a solvent having a high boiling point, which is solid at a normal temperature and an auxiliary solvent having low boiling point, or to add in a form of a so-called oilless emulsion dispersion not using the solvent having a high boiling point.

According to the invention, among the development accelerators described above, hydrazine type compound represented by the general formula (1) described in Japanese Patent Application No. 2001-074278 and the phenolic or naphtholic compound represented by the general formula (2) described in Japanese Patent Application No. 2000-76240 are particularly preferable.

Preferable specific examples of the development accelerator recited in the invention are shown below but the invention is not restricted to them.

(A-1)

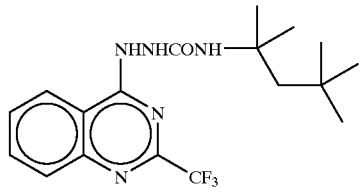

(A-2)

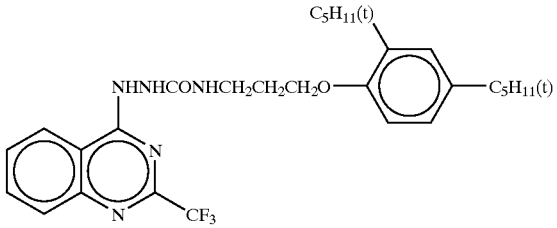

(A-3)

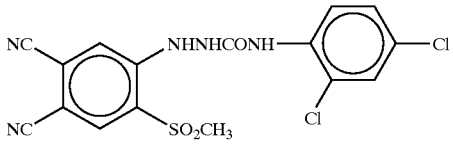

(A-4)

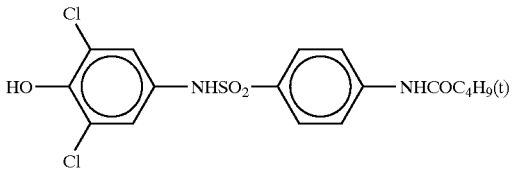

(A-5)

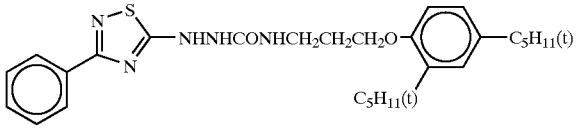

(A-6)

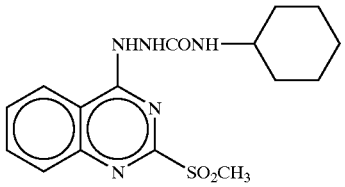

(A-7)

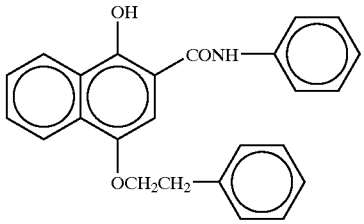

(A-8)

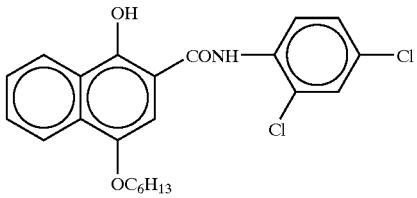

-continued (A-9)

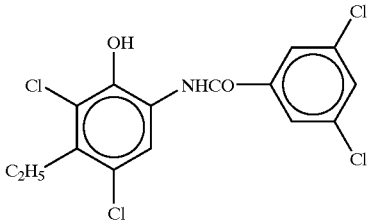

(A-10)

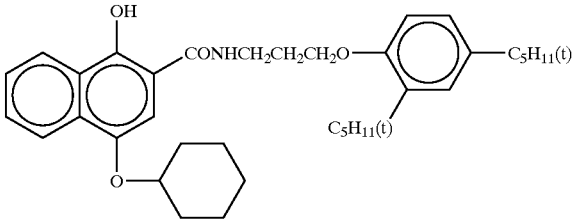

2-1-4. Hydrogen Bonding Compound

In the invention, it is preferable to use a non-reducing compound having a group capable of forming a hydrogen bond with the aromatic hydroxyl group (—OH) of the reducing agent in combination.

The group capable of forming the hydrogen bond can include, for example, phosphoryl group, sulfoxide group, sulfonyl group, carbonyl group, amide group, ester group, urethane group, ureido group, tertiary amino group and nitrogen-containing aromatic group. Among them, preferable groups are those compounds having phosphoryl group, sulfoxide group, and amide group (not having >N—H group and blocked as >N—Ra (Ra is a substituent other than H)), urethane group (not having >N—H group and blocked as >N—Ra (Ra is a substituent other than H)), and ureido group (not having >N—H group and blocked as >N—Ra (Ra is a substituent other than H)).

In the invention, particularly preferable hydrogen bonding compound is a compound represented by the following general formula (A).

General Formula (A)

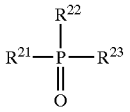

In the general formula (A), $R^{21}$ to $R^{23}$ each independently represent alkyl group, aryl group, alkoxy group, aryloxy group, amino group or heterocyclic group, and the group may be unsubstituted or have a substituent.

In the general formula (A), $R^{21}$, $R^{22}$ and $R^{23}$ each independently represent groups selected from alkyl group, aryl group, alkoxy group, amino group and hetero-cyclic group. Each of these groups may have a substituent.

The substituents for each of $R^{21}$, $R^{22}$ and $R^{23}$ can include, for example, halogen atom, alkyl group, aryl group, alkoxy group, amino group, acyl group, acylamino group, alkylthio group, arylthio group, sulfoneamide group, acyloxy group, oxycarbonyl group, carbamoyl group, sulfamoyl group, sulfonyl group and phosphoryl group. Preferable substituents are alkyl group or aryl group, for example, methyl group, ethyl group, isopropyl group, t-butyl group, t-octyl group, phenyl group, 4-alkoxyphenyl group, and 4-acyloxyphenyl group.

The alkyl group for $R^{21}$, $R^{22}$ and $R^{23}$ can include, specifically, methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, and 2-phenoxypropyl group.

The aryl group can include, for example, phenyl group, cresyl group, xylyl group, naphthyl group, 4-t-butylphenyl group, 4-t-octylphenyl group, 4-anisidyl group, and 3,5-dichlorophenyl group.

The alkoxy group can include, for example, methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group and benzyloxy group.

The aryloxy group can include, for example, phenoxy group, cresyloxy group, isopropylphenoxy group, 4-t-butylphenoxy group, naphthoxy group, and biphenyloxy group.

The amino group can include, for example, dimethylamino group, diethylamino group, dibutylamino group, dioctylamino group, N-methyl-N-hexylamino group, dicyclohexylamino group, diphenylamino group, and N-methyl-N-phenylamino group.

$R^{21}$, $R^{22}$ and $R^{23}$ are preferably alkyl group, aryl group, alkoxy group and aryloxy group. In view of the effect of the invention, it is preferable that at least one or more of $R^{21}$, $R^{22}$ and $R^{23}$ is alkyl group or aryl group and, it is more preferable that two or more of them are alkyl group or aryl group. Further, with a view point of availability with a low cost, it is preferable that $R^{21}$, $R^{22}$ and $R^{23}$ are identical groups.

Specific examples of the hydrogen bonding compounds including the compound of the general formula (A) in the present invention are shown below but invention is not restricted to them.

(A-1)

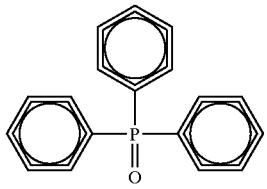

(A-2)

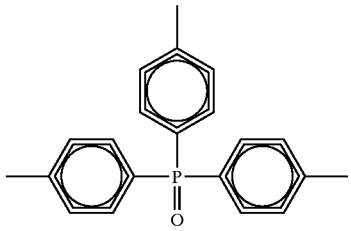

(A-3)

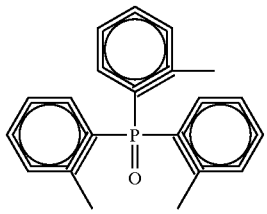

-continued (A-4)

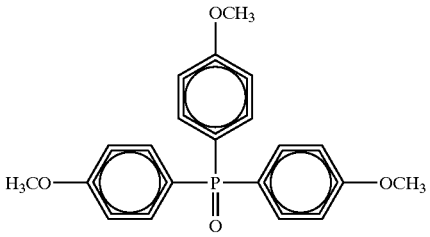

(A-5)

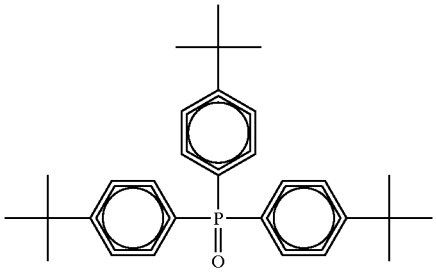

(A-6)

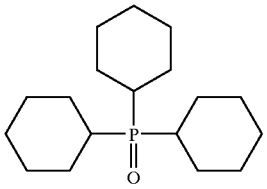

(A-7)

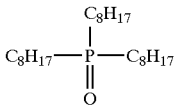

(A-8)

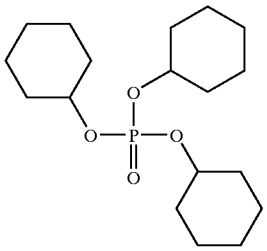

(A-9)

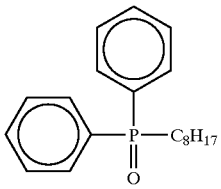

(A-10)

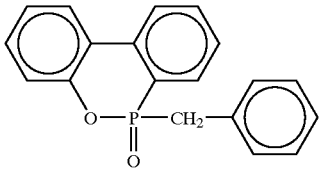

-continued (A-11)

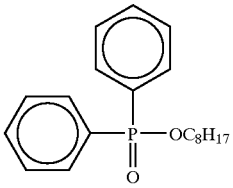

(A-12)

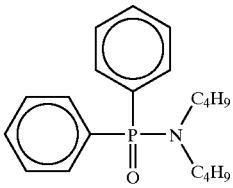

(A-13)

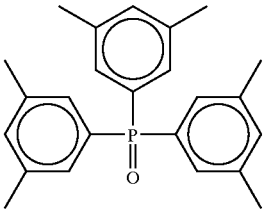

(A-14)

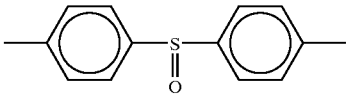

(A-15)

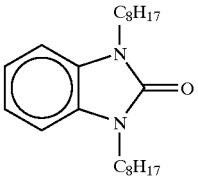

(A-16)

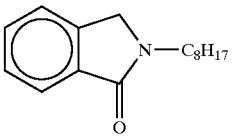

(A-17)

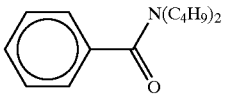

Specific examples of the hydrogen bonding compounds can include those described in Japanese Patent Application Nos. 2000-192191 and 2000-194811 in addition to the compounds described above.

The hydrogen bonding compound recited in the invention, like the reducing agent, can be contained in the coating liquid in a form of the solution, emulsion dispersion or fine solid grain dispersion to be used in the photosensitive material. The compound recited in the invention forms a complex compound by hydrogen bonds with a compound having a phenolic hydroxyl group in a state of solution and the complex can be isolated in a crystalline form in some combinations between the reducing agent and the compound of the general formula (A) of the invention.

Use of the thus isolated crystalline powder as the fine solid grain dispersion is particularly preferable in order to obtain a stable property. Further, a method of mixing the reducing agent and the hydrogen bonding compound recited in the invention in a powder state and forming a complex compound during dispersion by a sand grinder mill or the like using an appropriate dispersant can also be used preferably.

The hydrogen bonding compound of the invention is used preferably in an amount of 1 to 200% by mol based on the reducing agent and, it is more preferably, in an amount of 10 to 150% by mol and, further preferably, in an amount of 30 to 100% by mol.

2-1-5. Binder

The binder for the organic silver salt containing layer recited in the invention may be any polymer and a preferable binder is transparent or semi-transparent and, generally colorless, and it includes a natural resin, polymer and copolymer thereof, synthetic resin, polymer and copolymer thereof and other film forming media, for example, gelatins, rubbers, polyvinyl alcohols, hydroxyethyl celluloses, cellulose acetates, cellulose acetate butyrates, polyvinylpyrrolidones, casein, starch, polyacrylic acids, polymethylmethacrylate acids, polyvinyl chlorides, polymethacrylic acids, styrene-maleic acid anhydride copolymers, styrene-acrylonitrile copolymers, styrene-butadiene copolymers, polyvinylacetals (for example, polyvinylformal and polyvinylbutyral), polyesters, polyurethanes, phenoxy resin, polyvinylidene chlorides, polyepoxides, polycarbonates, polyvinyl acetates, polyolefins, cellulose esters and polyamides. The binder may be formed from water or organic solvents or emulsions.

According to the invention, the glass transition temperature of the binder in the layer containing the organic silver salt is preferably in a range from −20° C. to 80° C. and, preferably, from 0° C. to 70° C. and, further preferably, from 10° C. to 65° C.

In the present invention, Tg is calculated by the following equation:

$$1/Tg=\Sigma(Xi/Tgi)$$

In the equation, it is assumed that n monomer ingredients each corresponding to one of numbers from 1 to n (i=1 to n), are copolymerized in the polymer. Xi represents a weight fraction of the $i_{th}$ monomer ($\Sigma Xi=1$) and Tgi represents a glass transition temperature (absolute temperature) of a homopolymer of the $i_{th}$ monomer. Σ represents the sum of the value for individual i (i=1 to n).

As the value for the glass transition temperature of the homopolymer of each of the monomers (Tgi), the value described in Polymer Handbook (3rd Edition) (written by J. Brandrup, E. H. Immergut (Wiley-Interscience, 1989)) is adopted.

The polymer used for the binder may be used solely, or in combination of two or more of them, optionally. Further, a polymer having a glass transition temperature of 20° C. or more and a polymer having a glass transition temperature of 20° C. or less may be used in combination. In a case of using a blend of two or more types of polymers having different Tg, it is preferable that the weight average Tg thereof is within the range described above.

According to the invention, in a case in which the organic silver salt containing layer is formed by coating and drying a coating liquid comprising water at 30% by mass or more based on the solvent, and further in a case where the binder of the organic silver salt containing layer is soluble or dispersible in an aqueous solvent (water solvent), and particularly, in a case the binder is comprised by a polymer latex with the equilibrium moisture content at 25° C., 60% RH is 2% by mass or less, the property is improved.

A most preferable form is prepared in which the ionic conduction is 2.5 mS/cm or less and the preparation method includes a purification treatment in which a separation membrane is used after synthesis of the polymer.

The aqueous solvent in which the polymer is soluble or dispersible described herein is water or water mixed with 70% by mass or less of water miscible organic solvent.

The water miscible organic solvent can include, for example, alcohols such as methyl alcohol, ethyl alcohol, and propyl alcohol, cellosolves such as methyl cellosolve, ethyl cellosolve and butyl cellosolve, ethyl acetate and dimethyl formamide.

Further, "equilibrium moisture content at 25° C., 60% RH" can be represented as below by using the weight W1 of a polymer in a controlled humidity equilibrium in an atmosphere at 25° C., 60% RH and weight W0 of a polymer in an absolutely dried state at 25° C.

$$\text{Equilibrium moisture content at 25° C., 60\% RH}=[(W1-W0)/W0]\times 100\ (\%\text{ by mass})$$

The definition and the measuring method for the moisture content can be referred, for example, to High Molecule Engineering Course 14, High Molecule Material Test Method (edited by High Molecule Society, Chijin Shokan).

The equilibrium moisture content of the binder polymer recited in the invention at 25° C., 60% RH is, preferably, 2% by mass or less, more preferably, in a range from 0.01% by mass to 1.5% by mass and, further preferably, from 0.02% by mass to 1% by mass.

The binder recited in the invention is particularly preferably a polymer dispersible in an aqueous solvent. Example of the dispersion state can include a latex in which fine grains of water insoluble hydrophobic polymer are dispersed, or polymer molecules dispersed in a state of a molecule or a micelle, and both are preferable. The average grain size of the dispersed grains is, preferably within a range from 1 to 50,000 nm and, more preferably, 5 to 1000 nm. There is no particular restriction on the grain size distribution of the dispersed grains and it may be either those having a wide grain size distribution or those having a grain size distribution of mono dispersion.

Preferable embodiments of the polymer dispersible in the aqueous solvent recited in the invention include hydrophobic polymers such as acrylic polymer, polyesters, rubbers (for example, SBR resin), polyurethanes, polyvinyl chlorides, polyvinyl acetates, polyvinylidene chlorides, and polyolefins. The polymers may be linear, branched or crosslinked polymers. They may be a so-called homopolymer in which single type monomers are polymerized, or copolymer in which two or more types of monomers are polymerized. The copolymer may include random copolymer and block copolymer.

The molecular weight of the polymer is from 5,000 to 1,000,000 preferably, 10,000 to 200,000 as a number average molecular weight. Those having excessively small molecular weights are insufficient in the kinetic strength of the emulsion layer while those having excessively large molecular weights are poor in the film forming property.

Specific examples of the preferable polymer latex can include the followings. In the following descriptions, they are represented by means of starting monomers, numerical values in blankets represent% by mass and the molecular weight is a number average molecular weight. In a case of using the polyfunctional monomer, since the concept of the molecular weight can not be applied due to a crosslinked structure, they are described as crosslinking, with the description for the molecular weight being omitted. Tg represents the glass transition temperature.

P-1; MMA(70)-EA(27)-MAA(3)-Latex (molecular weight 37,000, Tg 61° C.)

P-2; MMA(70)-2EHA(20)-St(5)-AA(5)-Latex (molecular weight 40,000, Tg 59° C.)

P-3; St(50)-Bu(47)-MAA(3)-Latex (closslinking, Tg −17° C.)

P-4; St(68)-Bu(29)-AA(3)-Latex (closslinking, Tg 17° C.)

P-5; St(71)-Bu(26)-AA(3)-Latex (closslinking, Tg 24° C.)

P-6; St(70)-Bu (27)-IA(3)-Latex (closslinking)

P-7; St(75)-Bu(24)-AA(1)-Latex (closslinking, Tg 29° C.)

P-8; St(60)-Bu (35)-DVB(3)-MAA(2)-Latex (closslinking)

P-9; St(70)-Bu (25)-DVB(2)-AA(3)-Latex (closslinking)

P-10; VC(50)-MMA(20)-EA(20)-AN(5)-AA(5) Latex (molecular weight 80,000)

P-11; VDC(85)-MMA(5)-EA(5)-MAA(5) Latex (molecular weight 67,000)

P-12; Et(90)-MMA(10)-Latex (molecular weight 12,000)

P-13; St(70)-2EHA(27)-AA(3)-latex (molecular weight 130,000, Tg 43° C.)

P-14; MMA(63)-EA(35)-AA(2)-latex (molecular weight 33,000, Tg 47° C.)

P-15; St(70.5)-Bu(26.5)-AA(3)-latex (closslinking, Tg 23° C.)

P-16; St(69.5)-Bu(27.5)-AA(3)-latex (closslinking, Tg 20.5° C.)

Abbreviations for the structure described above represent the following monomers. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinyl benzene, VC: vinyl chloride, AN: acrylonitrile, VDC: vinylidene chloride, Et: ethylene, IA: itaconic acid.

The polymer latexes described above are also marketed and the following polymers can be utilized. Examples of the acrylic polymer include SEVIAN A-4635, 4718, 4601 (all manufactured by Daicel Chemical Industry Co.) Nipol Lx 811, 814, 821, 820, 857 (all manufactured by Nippon Zeon Co.), examples of polyesters include FINETEX ES 650, 611, 675, 850 (all manufactured by Dainippon Ink Chemical Co.), WD-size, WMS (all manufactured by Eastman Chemicals), examples of polyurethanes include HYDRAN AP 10, 20, 30, 40 (all manufactured by Dainippon Ink Chemical Co.), examples of rubber include LACSTAR 7310K, 3307B, 4700H, 7132C (all manufactured by Dainippon Ink Chemical Co.), Nipol LX 416, 410, 438C, 2507 (all manufactured by Nippon Zeon Co.), examples of polyvinyl chlorides include G351, G576 (all manufactured by Nippon Zeon Co.), examples of polyvinylidene chlorides include L502, L513 (all manufactured by Asahi Kasei Industry Co.) and examples of polyolefins include, CHEMIPEARL S120., SA100 (all manufactured by Mitsui Petrochemical Co.).

The polymer latex described above may be used alone or, optionally, two or more of them may be blended.

As the polymer latex recited in the invention, a latex of styrene-butadiene copolymer is particularly preferable. The weight ratio between the monomer unit of the styrene and the monomer unit of the butadiene in the styrene-butadiene copolymer is preferably 40:60 to 95:5. Further, the proportion of the styrene monomer unit and the butadiene monomer unit in the copolymer is preferably 60 to 99% by mass. A preferable range of the molecular weight is identical with that described above.

The preferable latex of styrene-butadiene copolymer recited in the invention can include P-3 to P-8, 14, 15, and LACSTAR-3307B, 7132C, Nipol Lx416, which are commercially available, and the like.

In the organic silver salt containing layer of the photosensitive material recited in the invention, hydrophilic polymer such as gelatin, polyvinyl alcohol, methyl cellulose, hydroxypropyl cellulose and carboxymethyl cellulose may also be added, if necessary.

The addition amount of the hydrophilic polymer is preferably 30% by mass or less and, more preferably, 20% by mass or less based on the entire binder in the organic silver salt containing layer.

The organic silver salt containing layer (that is, the image forming layer) recited in the invention is preferably formed by using a polymer latex as a binder. The binder in the organic silver salt containing layer is preferably contained in an amount in which the weight ratio of entire binder/organic silver salt is in a range from 1/10 to 10/1 and, further preferably, from 1/5 to 4/1.

Further, usually, the organic silver salt containing layer is also a photosensitive layer (emulsion layer) containing the photosensitive silver halide as the photosensitive silver salt in which the weight ratio for the entire binder/silver halide is within a range, preferably, from 400 to 5 and, more preferably, from 200 to 10.

The entire amount of the binder in the image forming layer recited in the invention is within a range, preferably, from 0.2 to 30 g/m$^2$ and, more preferably, 1 to 15 g/m$^2$. In the image forming layer recited in the invention, a crosslinker used for closslinking and a surfactant for the improvement of the coating properties may also be added.

The solvent for the coating liquid for the organic silver salt containing layer of the photosensitive material recited in the invention (here, for simplicity, the solvent and the dispersion medium are collectively called "solvent") is preferably an aqueous solvent containing 30% by mass or more of water. As the ingredient other than water, any water-miscible organic solvents such as methyl alcohol, ethyl alcohol, isopropyl alcohol, methyl cellosolve, ethyl cellosolve, dimethyl formamide, and ethyl acetate may be used. The water content of the solvent is preferably 50% by mass or more and, further preferably, 70% by mass or more.

Preferable specific examples of the solvent composition can include water at 100, water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (numerical values represent% by mass).

2-1-6. Anti-Foggant

According to the invention, an anti-foggant containing the compound represented by the following general formula (H) is preferable. General formula (H)

$$Q\text{-}(Y)_n\text{—}C(Z_1)(Z_2)X$$

In the general formula (H), Q represents an alkyl group, aryl group or heterocyclic group, Y represents a bivalent connection group, n represents 0 or 1, $Z_1$ and $Z_2$ each represent a halogen atom and X represents a hydrogen atom or an electron attractive group.

Q preferably represents a phenyl group substituted with an electron attractive group having a positive value of Hammett's substituent constant σp. Regarding the Hammett's" substituent constant, refer to Journal of Medicinal Chemistry, 1973, vol. 16, No. 11, pp 1207–1216.

The electron attractive group described above can include, for example, halogen atom (fluorine atom (σp value: 0.06), chlorine atom (σp value: 0.23), bromine atom (σp value: 0.23), iodine atom (σp value: 0.18)), trihalomethyl group (tribromomethyl (σp value: 0.29), trichloromethyl (σp value: 0.33), trifluoromethyl (σp value: 0.54)), cyano group (σp value: 0.66), nitro group (σp value: 0.78), aliphatic, aryl or heterocyclic sulfonyl group (for example, methanesulfonyl (σp value: 0.72)), aliphatic, aryl or heterocyclic acyl group (for example, acetyl (σp value: 0.50), benzoyl (σp value: 0.43)), alkinyl group (for example, C≡CH (σp value: 0.23)), aliphatic, aryl or heterocyclic oxycarbonyl group (for example, methoxy carbonyl (σp value: 0.45), phenoxycarbonyl (σp value: 0.44)), carbamoyl group (σp value: 0.36), sulfamoyl group (σp value: 0.57), sulfoxide group, heterocyclic group and phosphoryl group.

The σp value is preferably in a range from 0.2 to 2.0 and, more preferably, in a range from 0.4 to 1.0.

Preferable electron attractive groups are carbamoyl group, alkoxycarbonyl group, alkylsulfonyl group, alkylphosphoryl group, carboxyl group, alkyl or aryl carbonyl group, and aryl sulfonyl group, and particularly preferable are carbamoyl group, alkoxycarbonyl group, alkylsulfonyl group, and alkylphosphoryl group, carbamoyl group being most preferable.

X is preferably an electron attractive group and, more preferably, halogen atom, aliphatic, aryl or heterocyclic sulfonyl group, aliphatic, aryl or heterocyclic acyl group. aliphatic, aryl or heterocyclic oxycarbonyl group, carbamoyl group, sulfamoyl group and, particularly preferably, halogen atom.

Among the halogen atoms, preferable are chlorine atom, bromine atom and iodine atom, and further preferable are chlorine atom and bromine atom, with bromine atom being particularly preferable.

Y represents preferably —C(=O)—, —SO— or —$SO_2$— and, more preferably, —C(=O)—, and —$SO_2$— and, particularly preferably, —$SO_2$—. n represents 0 or 1, 1 being preferable.

Specific examples of the compound of the general formula (H) of the invention are shown below but the invention is not restricted to them.

(H-1)

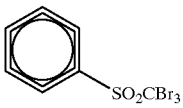

(H-2)

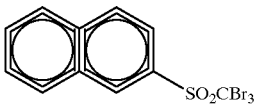

(H-3)

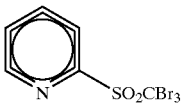

(H-4)

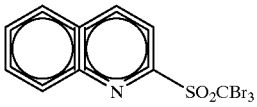

(H-5)

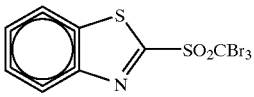

-continued (H-6)

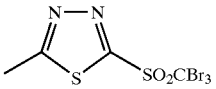

(H-7)

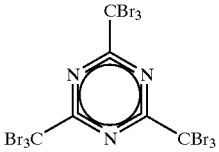

(H-8)

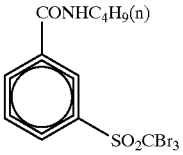

(H-9)

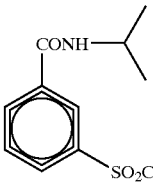

(H-10)

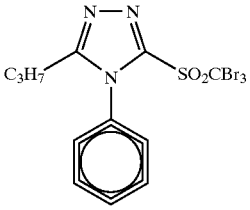

(H-11)

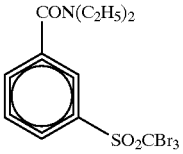

(H-12)

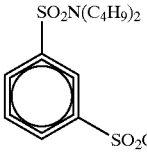

(H-13)

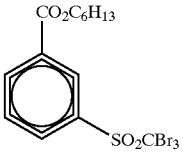

(H-14)

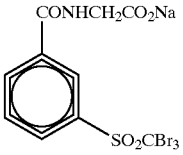

-continued (H-15)

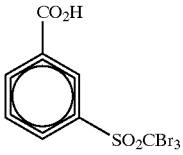

(H-16)

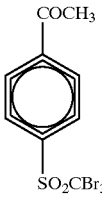

(H-17)

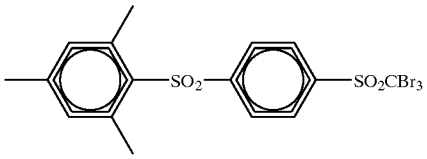

(H-18)

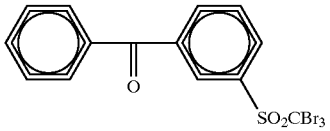

(H-19)

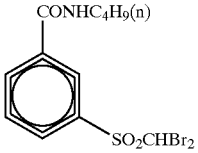

(H-20)

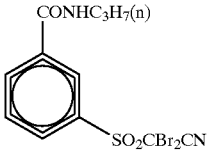

(H-21)

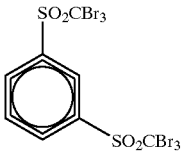

(H-22)

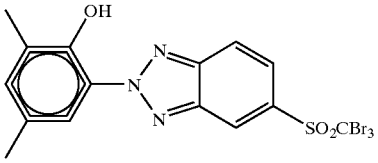

(H-23)

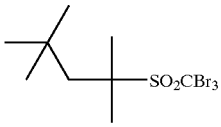

The compound represented by the general formula (H) recited in the invention is used, preferably, in an amount of $10^{-4}$ to 0.8 mol, more preferably, in an amount of $10^{-3}$ to 0.1 mol and, further preferably, in an amount of $5\times10^{-3}$ to 0.05 mol based on one mol of the non-photosensitive silver salt in the image forming layer.

Particularly, in a case of using a silver halide of a composition with high silver iodide content recited in the invention, the addition amount of the compound of the general formula (H) is important in order to obtain a sufficient anti-fogging effect and it is most preferable that it is used in an amount of $5\times10^{-3}$ to 0.03 mol.

According to the invention, the methods for incorporating the compound represented by the general formula (H) in the photosensitive material can include the methods described for incorporating the reducing agent.

Melting point of the compound represented by the general formula (H) is, preferably, 200° C. or lower and, further preferably, 170° C. or lower.

Other organic polyhalogen compounds used according to the invention can include those disclosed in JP-A No. 11-65021; column Nos. 0111 to 0112. Particularly, the organic halogen compound represented by the formula (P) in Japanese Patent Application No. 11-87297, an organic polyhalogen compound represented by the general formula (II) in JP-A No. 10-339934 and the organic polyhalogen compounds described in Japanese Patent Application No. 11-205330 are preferable.

2-1-7. Other Anti-Foggants

Other anti-foggants can include mercury (II) salt disclosed in JP-A No. 11-65021; column No. 0113, benzoic acid in column No. 0114 of the same publication, salicylic acid derivatives in JP-A No. 2000-206642, formalin scavenger compound represented by the formula (S) in JP-A No. 2000-221634, triazine compound recited in claim 9 in JP-A No.11-352624, the compound represented by the general formula (III) in JP-A No. 6-11791 and 4-hydroxy-6-methyl-1,3,3a,7-tetrazaindene.

The anti-foggant, the stabilizer and the stabilizer precursor usable in the invention can include those compounds described in JP-A No. 10-62899; column No. 0070, EP No. 0803764A1, page 20, line 57 to page 21, line 7, JP-A No. 9-281637 and No. 9-329864.

The thermally developable photosensitive material in the invention may contain an azolium salt for an anti-fogging purpose. The azolium salt can include the compound represented by the general formula (XI) described in JP-A No. 59-193447, the compound described in JP-B No. 55-12581, and the compound represented by the general formula (II) described in JP-A No. 60-153039. The azolium salt may be added to any portion of the photosensitive material and it is preferably added to the layer on the surface having the photosensitive layer and it is further preferable to add to the organic silver salt containing layer.

Referring to the addition time of the azolium salt, it may be added at any step for the preparation of coating liquid and, in a case it is added to the organic silver salt containing layer, it may be added at any step from preparation of the organic silver salt to preparation of the coating liquid and it is preferably added at a time from the completion of the preparation of organic silver salt, to just before coating. The azolium salt may be added by any method such as in the form of powder, solution and fine grain dispersion. Further, it may be added as a solution mixed with other additives such as a sensitizing dye, reducing agent, toning agent.

The addition amount of the azolium salt recited in the invention may be any amount and it is, preferably, in a range from $1\times10^{-6}$ mol to 2 mol and, further preferably, from $1\times10^{-3}$ mol to 0.5 mol based on one mol of silver.

2-1-8. Other Additives

1) Mercapto, Disulfide and Thions

According to the invention, for controlling the development by suppressing or promoting development, for improving the spectral sensitizing efficiency and improving the shelf stability before and after development, mercapto compounds, disulfide compounds and thion compounds can be incorporated. Compounds in JP-A No. 10-62899: column Nos. 0067 to 0069, the compound represented by the general formula (I) of JP-A No. 10-186572 and specific examples are disclosed in column Nos. 0033 to 0052 of JP-A No. 10-186572, EP-A No. 0803764A1, page 20, lines 36 to 56 and Japanese Patent Application No. 11-273670. Among them, mercapto substituted heterocyclic aromatic compounds are preferable.

2) Toning Agent

In the thermal development sensitive material of the invention, the toning agent is added preferably and the toning agent is described in JP-A No. 10-62899; column Nos. 0054 to 0055, EP-A No. 0803764A1 in page 21, lines 23-48, JP-A No. 2000-356317 and Japanese Patent Application No. 2000-187298. Particularly, phthalazinones (phthalazinone, phthalazinone derivatives or metal salts; for example, 4-(1-naphthyl) phthalazinone, 6-chlorophthalazinone, 5,7-dimethoxyphthalazinone and 2,3-dihydro-1,4-phthalazinedione); combinations of phthalazinones and phthalic acids (for example, phthalic acid, 4-methyl phthalic acid, 4-nitro phthalic acid, diammonium phthalate, sodium phthalate, potassium phthalate, and tetrachloro phthalic acid anhydride); phthalazines (phthalazine, phthalazine derivatives or metal salts; for example, 4-(1-naphthyl)phthalazine, 6-isopropyl phthalazine, 6-t-butyl phthalazine, 6-chlorophthalazine, 5,7-dimethoxyphthalazine and 2,3-dihydrophthalazine) are preferable and, a combination of phthalazines and phthalic acids is particularly preferable in a combination with a silver halide high in silver iodide content.

A preferable addition amount of phthalazines is 0.01 mol to 0.3 mol and, more preferably, 0.02 to 0.2 mol and, particularly preferably, 0.02 to 0.1 mol based on one mol of organic silver salt. The addition amount is an important factor for the promotion of the development which is a subject in the silver halide emulsion of a composition with high silver iodide content recited in the invention. Sufficient development performance and low fogging property are compatible with each other by the selection of an appropriate addition amount.

3) Plasticizer, Lubricant

The plasticizers and the lubricants usable in the photosensitive layer recited in the invention are described in JP-A No. 11-65021; column No. 0117. The sliding agent is described in JP-A No. 11-84573; column Nos. 0061 to 0064 and Japanese Patent Application No. 11-106881; column Nos. 0049 to 0062.

4) Dye, Pigment

In the photosensitive layer recited in the invention, various kinds of dyes and pigments (for example, C.I. Pigment Blue 60, C.I. Pigment Blue 64, C. I. Pigment Blue 15:6) can be used with a view point of improving the tone, prevention for the occurrence of interference fringes upon laser exposure and prevention of irradiation. They are specifically described in WO98/36322, JP-A Nos. 10-268465 and 11-338098.

5) Gradation Ultra-Hardening Agent

A gradation ultra-hardening agent is preferably added to the image forming layer for forming ultra-high contrast images suitable for the use for printing plate production. The gradation ultra-hardening agent and the addition method and the addition amount thereof are described in column No. 0118, columns Nos. 0136 to 0193, of the publication, JP-A No. 11-223893, and the examples include compounds of the formula (H), formulae (1)-(3) and formulae (A), (B) of Japanese Patent Application No. 11-87297 specification and the compounds of the general formulae (III)-(V) of Japanese Patent Application No. 11-91652 specification (specific compounds: Chem 21-Chem 24). And the examples of contrast enhancer are described in JP-A No. 11-65021, column No. 0102 and JP-A No. 11-223898; column Nos. 0194 to 0195.

For using formic acid or formate as a strong fogging agent, it is preferably contained by 5 mm mol or less and, further preferably 1 mm mol or less per one mol of silver, on the side having the image forming layer containing the photosensitive silver halide.

In a case of using the gradation ultra-hardening agent in the thermally developable photosensitive material of the invention, it is preferable to use an acid formed by hydration of diphosphorus pentaoxide or salts thereof in combination. The acid formed by hydration of diphosphorus pentaoxide or the salts thereof can include meta-phosphoric acid (salt), pyro-phosphoric acid (salt), ortho-phosphoric acid (salt), tri-phosphoric acid (salt), tetra-phosphoric acid (salt), hexameta-phosphoric acid (salt). The salt formed by hydration of diphosphorus pentaoxide or the salts thereof used particularly preferably can include, orthophosphoric acid (salt) and hexametaphosphoric acid (salt). Specific salts can include sodium orthophosphate, sodium dihydrogen orthophosphate, sodium hexametaphosphate and ammonium hexametaphosphate.

The use amount of an acid formed by hydration of diphosphorus pentaoxide or the salts thereof (coating amount per 1 $m^2$ of photosensitive material) may be any desired amount in accordance with the performance such as sensitivity or fogging and it is, preferably, 0.1 to 500 $mg/m^2$ and, more preferably, 0.5 to 100 $mg/m^2$.

2-1-9. Preparation and Coating of Coating Liquid

The preparation temperature for the coating solution of the image forming layer recited in the invention is preferably in a range from 30° C. to 65° C. and, further preferably, from 35° C. to 60° C. and a further preferable temperature is in a range from 35° C. to 55° C. Further, the temperature of the coating solution for the image forming layer just after the addition of the polymer latex is preferably kept in a range from 30° C. to 65° C.

2-2. Other Layers and Constituent Ingredients

The thermally developable photosensitive material of the invention may have a non-photosensitive layer in addition to the image forming layer. The non-photosensitive layer can be classified in view of the arrangement thereof into (a) a surface protection layer disposed on the image forming layer (on the side remote from the support), (b) an intermediate layer disposed between a plurality of image forming layers or between a image forming layer and a protection layer, (c) an undercoat layer disposed between the image forming layer and the support and (d) a back layer disposed on the side opposite to the image forming layer.

Further, a layer that functions as an optical filter may be provided and this is disposed as the layer (a) or (b). An anti-halation layer is disposed as a layer (c) or (d) in the photosensitive material.

1) Surface Protection Layer

In the thermally developable photosensitive material according to the invention, a surface protection layer can be provided with an aim of preventing adhesion of the image forming layer. The surface protection layer may be a single layer or plural layers. The surface protection layer is described in JP-A No. 11-65021; column Nos. 0119 to 0120 and Japanese Patent Application No. 2000-171936

The binder for the surface protection layer of the invention is preferably a gelatin and it is also preferable to use polyvinyl alcohol (PVA) alone or in combination. As a gelatin, inert gelatin (for example, Nitta gelatin 750), phthalized gelatin (for example, Nitta gelatin 801) can be used.

PVA can include those described in JP-A No. 2000-171936; column Nos. 0009 to 0020, and they include, preferably, entirely saponified product PVA-105 and partially saponified product PVA-205 and PVA-335, and modified polyvinyl alcohol MP-203 (all are trade names of products manufactured by Kuraray Co.)

The coating amount of polyvinyl alcohol (per 1 $m^2$ of support) for the protection layer (per one layer) is, preferably, in a range from 0.3 to 4.0 $g/m^2$ and, more preferably, from 0.3 to 2.0 $g/m^2$.

The coating amount (per 1 $m^2$ support) of the entire binder (comprising water soluble polymers and latex polymers) in the surface protection layer (per 1 layer) is, preferably, from in a range from 0.3 to 5.0 $g/m^2$ and, more preferably, from 0.3 to 2.0 $g/m^2$.

2) Anti-Halation Layer

In the thermally developable photosensitive material of the invention, an anti-halation layer can be disposed on the side opposite to an exposure light with respect to the photosensitive layer. The anti-halation layer is described in JP-A No. 11-65021; column Nos. 0123 to 0124, JP-A Nos. 11-223898,9-230531, 10-36695, 10-104779,11-231457, 11-352625 and 11-353626.

The anti-halation layer contains an anti-halation dye having absorption at an exposure wavelength. In a case where the exposure wavelength is in an infrared region, an infrared absorption dye may be used and, in this case, a dye not having absorption in a visible region is preferable.

In a case of preventing halation by using a dye having absorption in a visible region, it is preferable that the color of the dye does not substantially remains after image formation, and the dye is preferably achromatized using the heat of thermal development. Particularly, it is preferable to add a thermally achromatizable dye and a base precursor to the non-photosensitive layer and causing the same to act as an anti-halation layer. The techniques are described, for example, in JP-A No. 11-231457.

The addition amount of the achromatizable dye is determined depending on the use of the dye. Generally, it is used in such an amount that the optical density (absorption) exceeds 0.1 when measured at an aimed wavelength (generally). The optical density is preferably in a range from 0.2 to 2. The amount of the dye used for obtaining such an optical density is generally about 0.001 to 1 $g/m^2$.

When such dye is achromatized, the optical density after the thermal development can be lowered to 0.1 or less. Two or more kinds of achromatizable dyes may be used in combination for the heat achromatizing recording material or thermally developable photosensitive material. In the same manner, two or more kinds of base precursors may be used in combination.

In the thermal discharging using the achromatizable dye and the base precursor described above, it is preferable to use a substance that lowers the melting point by 3° C. (deg) or more when mixed with the base precursor as described in JP-A No. 11-352626 (for example, diphenyl sulfone, 4-chlorophenyl(phenyl)sulfone) in combination in view of thermally achromatizing property.

3) Back Layer

The back layer applicable to the invention is described in JP-A No. 11-65021; column Nos. 0128 to 0130.

According to the invention, a colorant having an absorption maximum in a range from 300 to 450 nm can be added with an aim of improving the aging change properties of silver tone and images. The colorant is described, for example, in JP-A Nos. 62-210458, 63-104046, 63-103235, 63-208846, 63-306436, 63-314535 and 01-61745, and Japanese Patent Application No. 11-276751. The colorant is usually added in an amount of 0.1 $mg/m^2$ to 1 $g/m^2$ and it is added, preferably, to a back layer disposed on the side opposite to the photosensitive layer.

4) Matting Agent

According to the invention, a matting agent is preferably added for the improvement of the transportability to the surface protection layer and the back layer. The matting agent is described in JP-A No. 11-65021; column Nos. 0126 to 0127.

The coating amount of the matting agent per 1 $m^2$ of the photosensitive material is, preferably, in an amount of 1 to 400 $mg/m^2$ and, more preferably, from 5 to 300 $mg/m^2$.

The degree of matte on the emulsion surface may be at any level so long as it does not cause so-called star dust failure in which a small white blanking arises in the image area and causes light leakage. It is preferable that the Beck smoothness is in a range from 30 sec to 2000 see and, particularly preferably, from 40 sec to 1500 sec. The beck smoothness can be determined easily according to Japanese Industry Standards (JIS) P8119 "Smoothness test method for paper and paper board by a Beck tester" and according to TAPPI standard method T479.

The degree of matte of the back layer recited in the invention is such that the Beck smoothness is preferably in a range from 10 sec to 1200 sec and, more preferably, from 20 see to 800 sec and, further preferably, from 40 sec to 500 sec.

According to the invention, the matting agent is contained preferably in the outermost surface layer or a layer that functions as the outermost surface layer, or a layer near the outer surface of the photosensitive material, or it is preferably contained in the layer that functions as a so-called protection layer.

5) Polymer Latex

A polymer latex can be added to the surface protection layer or the back layer recited in the invention.

The polymer latex is also described in "Synthetic Resin Emulsion (edited by Taira Okuda, Hiroshi Inagaki, published from High Molecular Publishing Society (1978))", "Application of Synthetic Latex (edited by Takaaki Sugimura, Yasuo Kataoka, Soichi Suzuki and Keiji Kasahara, published from High Molecular Publishing Society (1993))", "Chemistry of Synthetic Latex (written by Soichi Muroi, Published from High Molecular Publishing Society (1970))". Specifically the examples of the latex can include, latex of methyl methacrylate (33.5% by mass)/ethyl acrylate (50% by mass)/methacrylic acid (16.5% by mass) copolymer, latex of methyl methacrylate (47.5% by mass)/butadiene (47.5% by mass)/itaconic acid (5% by mass) copolymer, latex of ethyl acrylate/methacrylic acid copolymer, latex of methyl methacrylate (58.9% by mass)/2-ethylhexyl acrylate (25.4% by mass)/styrene (8.6% by mass)/2-hydroxyethyl methacrylate (5.1% by mass)/acrylic acid (2.0% by mass) copolymer, and latex of methyl methacrylate (64.0% by mass)/styrene (9.0% by mass)/butyl acrylate (20.0% by mass)/2-hydroxyethyl methacrylate (5.0% by mass)/acrylic acid (2.0% by mass) copolymer.

The polymer latex is used, preferably, in an amount of 10% by mass to 90% by mass and, particularly preferably, in an amount of 20% by mass to 80% by mass based on the entire binder (including water soluble polymer and the latex polymer) of the surface protection layer or the back layer.

6) Film Surface pH

In the thermally developable photosensitive material recited in the invention, the pH on the film surface before the thermal development is, preferably, 7.0 or less and, more preferably, 6.6 or less. While there is no particular restriction for the lower limit, it may be about 3. A most preferable pH range is within a range from 4 to 6.2.

For controlling the film surface pH, it is preferable to use a non-volatile acid including an organic acid, for example, a phthalic acid derivatives and sulfuric acid, and a volatile base such as ammonia, from a view point of reducing the film surface pH. Particularly, since ammonia is easily vaporize and can be removed before coating step or thermal development, ammonia is preferable for attaining the low film surface pH.

Further, non-volatile bases such as sodium hydroxde, potassium hydroxide and lithium hydroxide are preferably used in combination with ammonia. The measuring method of the film surface pH is described in Japanese Patent Application No. 11-87297; column No. 0123.

7) Hardening Agent

A hardening agent may be used in each of the layers such as the photosensitive layer, the protection layer and the back layer recited in the invention.

Examples of the hardening agent includes various methods described in "THE THEORY OF THE PHOTOGRAPHIC PROCESS FOURTH EDITION" Written by T. H. James (Published from Macmillan Publishing Co., Inc. in 1977), in pages 77 to 87, and they can include chrome alum, sodium 2,4-dichloro-6-hydroxy-s-triazine, N,N-ethylenebis (vinylsulfone acetoamide), N,N-propylenebis(vinylsulfone acetoamide), as well as polyvalent metal ions described in 78 page of the literature, polysocyanates in U.S. Pat. No. 4,281,060 and JP-A No. 6-208193, epoxy compounds, for example, in U.S. Pat. No. 4,791,042 and vinylsulfonic compounds in JP-A No. 62-89048.

The hardening agent is added in the form of a solution and as to the addition time of the solution into the protection layer coating liquid, it is added within a period from 180 min before the coating to just before the coating and, preferably, from 60 min to 10 sec before the coating. The coating method and the coating condition have no particular restrictions so long as the effect of the invention can be attained sufficiently.

The specific mixing method can include a method in which the mixing is carried out in a tank and the average staying time calculated based on the addition flow rate and the liquid delivery rate to the coater, is controlled to a desired time, or a method using a static mixer as described in "Liquid Mixing Technology", written by N. Harnby, M. F. Edwards, A. W. Nienow and translated by Koji Takahashi (published from Nikkan Kogyo Shin bun Co. in 1989) in Chapter 8.

8) Surfactant

The surfactant applicable in the invention is described in JP-A No. 11-65021; column No. 0132.

In the invention, a fluorine type surfactant is used preferably. Preferable examples of the fluorine type surfactant can include those compounds described in JP-A Nos. 10-197985, 2000-19680, and 2000-214554. Further, a polymeric fluorine type surfactant described in JP-A No. 9-281636 is also used preferably. According to the invention, use of the fluorine type surfactant described in Japanese Patent Application No. 2000-206560 is particularly preferable.

9) Antistatic Agent

Further, antistatic layer containing various known metal oxides or conductive polymers may be incorporated. The antistatic layer may also serve as the undercoating layer and a back layer surface protection layer, or it may be disposed separately. For the antistatic layer techniques described in JP-A No. 11-65021; column No. 0135, JP-A Nos. 56-143430, 56-143431, 58-62646, 56-120519, and 11-84573; column Nos. 0040 to 0051, U.S. Pat. No. 5,575,957 and JP-A No. 11-223898; column Nos. 0078 to 0084 can be applied.

10) Support

For the transparent support, polyester, particularly, polyethylene terephthalate heat-treated at a temperature in a range from 130 to 185° C. is used preferably for moderating internal strains remaining in the film upon biaxial stretching and eliminating heat shrinkage strains caused during thermal development.

In the case of a thermally developable photosensitive material for medical use, the transparent support may be colored by a blue dye (for example, dye-1 described in Examples of JP-A No. 8-240877) or it may be uncolored.

Specific examples of the support are described in JP-A No. 11-65021: column No. 0134.

It is preferable that the undercoating techniques using a water soluble polyesters disclosed in JP-A No. 11-84574, styrene-butadiene copolymers disclosed in JP-A No. 10-186565, and vinyliden chloride copolymers disclosed in JP-A No. 2000-39684 and Japanese Patent Application No. 11-106881; column Nos. 0063 to 0080 are applied preferably to the support.

11) Other Additives

To the thermally developable photosensitive material, an antioxidant, a stabilizer, a plasticizer, a UV-ray absorbent or a coating assistant may further be added. The solvent described in JP-A No. 11-65021; column No. 0133 may be added. Each of the additives is added either to the photosensitive layer or the non-photosensitive layer. For them, WO98/36322, EP-A 803764A1, JP-A Nos. 10-186567 and 10-18568 can be referred.

12) Coating Method

The thermally developable photosensitive material in the invention may be coated by any method. Specifically, various coating operations including an extrusion coating, a slide coating, a curtain coating, a dip coating, a knife coating, a flow coating, an extrusion coating using a hopper of the types described in U.S. Pat. No. 2,681,294, or the like can be used. An extrusion coating and a slide coating described in "LIQUID FILM COATING" written by Stephen F. Kistler, Petert M. Schweizer (published from Chapman and Hall Co. in 1997) from page 399 to 536 are preferably used and particularly preferably, slide coating are used.

An example for the shape of the slide coater used for slide coating is shown in FIG. 11b.1 on page 427 of the literature. Further, if desired, two or more layers can be applied simultaneously by the method described in pages 399 to 536 of the literature and the method described in U.S. Pat. No. 2,761,791 and British Patent No. 837,095.

The coating liquid for the organic silver salt containing layer recited in the invention is preferably a so-called thixotropic fluid. As to the technique, JP-A No. 11-52509 can be referred.

The viscosity at a shearing rate of 0.1 $S^{-1}$ of the coating solution for the organic silver salt containing layer recited in the invention is preferably in a range from 400 mPa·s to 100,000 mPa·s and, more preferably, from 500 mPa·s to 20,000 mPa·s.

Further, at the shearing rate of 1000 $S^{-1}$, it is preferably in a range from 1 mPa·s to 200 mPa·s and, more preferably, from 5 mPa·s to 80 mPa·s.

13) Packaging material

The thermally developable photosensitive material recited in the invention is preferably seal packaged by a packaging material having low oxygen permeation rate and/or moisture permeation rate in order to prevent deterioration of photographic performance during storage before use, or to prevent curling or winding in a case of a product in a rolled state. The oxygen permeation rate at 25° C. is, preferably, 50 ml/atm/$m^2$·-day or less and, more preferably, 10 ml/atm/$m^2$ day or less and, further preferably, 1.0 ml/atm/$m^2$·day or less. The moisture permeability is, preferably, 10 g/atm/$m^2$·day or less, more preferably, 5 g/atm/$m^2$·day or less and, further preferably, 1 g/atm/$m^2$·day or less.

As specific examples of the packaging material with low oxygen permeability and/or moisture permeability, those described, for example, in JP-A Nos. 8-254793 and 2000-206653 can be utilized.

14) Other Utilizable Technique

The techniques that can be used for the thermally developable photosensitive material recited in the invention can also include, EP No. 803764A1, EP No. 883022A1, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569~10-186572, 10-197974, 10-197982, 10-197983, 10-197985~10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536~11-133539, 11-133542, 11-133543, 11-223898, 11-352627, 11-305377, 11-305378, 11-305384, 11-305380, 11-316435, 11-327076, 11-338096, 11-338098, 11-338099, 11-343420, Japanese Patent Application Nos. 2000-187298, 2000-10229, 2000-47345, 2000-206642, 2000-98530, 2000-98531, 2000-112059, 2000-112060, 2000-112104, 2000-112064, and 2000-171936.

In the case of the multi-color thermally developable photosensitive material, each of the emulsion layers is generally held being distinguished from each other by the use of a functional or non-functional barrier layer between each of the photosensitive layers as described in U.S. Pat. No. 4,460,681.

In the case of the multi-color thermally developable photosensitive material, the constitution may include a combination of the two layers for each color and it may include all the ingredients in a single layer as described in U.S. Pat. No. 4,708,928.

3. Image Forming Method

3-1. Exposure

The photosensitive material according to the invention may be exposed by any method. A laser beam is preferable as an exposure light source. A silver halide emulsion of high silver iodide content as recited in the invention has heretofore been accompanied by a problem of the low sensitivity. However, it has been found that the problem of the low sensitivity can be overcome by writing with a light giving a high illuminance such as a laser beam and an image can be recorded using less energy. Aimed sensitivity can be attained by writing in a short period by such an intense light.

Particularly, in a case of giving an exposure amount to provide a maximum density ($D_{max}$), a preferable amount of light on the surface of the photosensitive material is from 0.1 W/$mm^2$ to 100 W/$mm^2$. It is more preferably, from 0.5 W/$mm^2$ to 50 W/$mm^2$ and, most preferably, 1 W/$mm^2$ to 50 W/$mm^2$.

As the laser beam in the invention, a gas laser ($Ar^+$, He—Ne, He—Cd), a YAG laser, a dye laser and a semiconductor laser are preferable. Further, a semiconductor laser and a second harmonic generator can also be used. The laser used preferably is determined corresponding to the light absorption peak wavelength of the spectral sensitizing dye or the like of the thermally developable photosensitive material. And preferable examples include He—Ne laser emitting red-infrared light, a red semiconductor laser or $Ar^+$, He—Ne, He—Cd laser emitting blue-green light, and a blue semiconductor laser. The red-infrared semiconductor laser is preferable and the peak wavelength of the laser beam is in a range from 600 nm to 900 nm and, preferably, from 620 nm to 850 nm. On the other hand, a module comprising an SHG (Second Harmonic Generator) device and a semiconductor laser in integration or blue semiconductor laser has been developed in recent years and a laser output device for a short wavelength region has been highlighted. Since the blue semiconductor laser can record images at high fineness, and enables increasing the recording density and obtaining stable output having long life, it is expected that the demand will be increased in the feature. The peak wavelength of the blue laser beam is, preferably, in a range from 300 nm to 500 nm and, particularly, from 400 nm to 500 nm.

It is preferably utilized that the laser beam oscillates in a longitudinal multiple mode by the method, for example, of high frequency wave superposition.

3-2. Thermal Development

The thermally developable photosensitive material according to the invention may be developed by any method and, usually, a thermally developable photosensitive material exposed imagewise is developed by temperature elevation. A preferable developing temperature is in a range from 80 to 250° C. and it is further preferably from 100 to 140° C.

The developing time is, preferably, in a range from 1 to 60 sec, more preferably, from 5 to 30 see and, particularly preferably, from 5 to 20 sec.

A plate heater method is preferable for the thermally developing method. For the thermal development system by the plate heater method, a method described in JP-A No. 11-133572 is preferable which uses a thermal development apparatus. In the apparatus, a thermally developable photosensitive material on which a latent image is formed is brought into contact with a heating device at a thermal development station and a visible image is obtained on the thermally developable photosensitive material. The heating device comprises a plate heater. And plurality of opposed retainer rollers are disposed along one surface of the plate heater. And the thermally developable photosensitive material is passed between the retainer rollers and the plate heater to conduct thermal development. It is preferable that the plate heater is divided into 2 to 6 stages and the temperature is lowered by about 1 to 10° C. for the top end.

Such a method is described also in JP-A No. 54-30032 and a moisture or an organic solvent contained in the thermally developable photosensitive material can be eliminated out of the system. Further, deformation of the support of the thermally developable photosensitive material caused by rapid heating of the thermally developable photosensitive material can be suppressed.

3-3. System

A laser imager for medical use having an exposure station and a thermal developing station can include Fuji Medical Dry Imager FM-DPL and the system is described in Fuji Medical Review No. 8, P 39–55 and the techniques thereof can be utilized. Further, the thermally developable photosensitive material recited in the invention is also applicable as the thermally developable photosensitive material for the laser image in (AD network) proposed by Fuji Medical Co. as a network system adaptable to DICOM Standard.

4. Application of the Invention

There is no particular restriction for the range in which the high silver iodide photographic emulsion according to the present invention is used to black-and-white and color photographic photosensitive material and it can be used as photosensitive material for photography, for prints, for printing, for medical use, for industrial use, for diffusion transfer process, or for thermal development. Among them, use for the photosensitive material for thermal development is preferable.

The thermally developable photosensitive material using the high silver iodide photographic emulsion recited in the invention forms a black-and-white image by a silver image and is used preferably for the thermally developable photosensitive material for medical diagnosis, for industrial photography, for printing and for COM.

EXAMPLE

The present invention is to be described concretely by way of examples but the invention is not restricted to them.

Example 1

To a reaction vessel containing 1400 ml of water at 70° C. containing 36 g of gelatin, 724 ml of an aqueous solution containing 74 g of silver nitrate and 800 ml of an aqueous solution containing 113 g of potassium iodide were added simultaneously, while stirring the solution, by a controlled double jet method so as to keep a silver potential at +60 mV for 200 min. Then, desalination and water washing were conducted by an ultrafiltration method and, after dissolving gelatin additionally, pH was adjusted to 5.9 and pAg to 7.5. The obtained silver iodide grains had an average grain size of 0.14 $\mu$m and the variation coefficient of the grain size was 21%.

After dispensing the emulsion into 8 portions and elevating the temperature to 60° C., pAg for each of them was adjusted as shown in Table 1 and then a sulfur sensitizer (sodium thiosulfate) and a gold sensitizer (chloroauric acid) were added each in such an amount to give an optimal sensitization, which provide a maximum sensitivity, and each emulsion is ripened for 60 min to prepare emulsions 1 to 8. After controlling pAg of each emulsion to 7.0, 4-hydroxy-6-methyl-1,3,3a,7-tetraazaindene and 1-phenyl-5-mercapto tetrazole (stabilizer and anti-foggant), further, sodium dodecylbenzene sulfonate (coating assistant), 1,2-bis(vinyl sulfonyl acetyl amino) ethane (hardening agent), and phenoxy ethanol (antiseptic) were added and coated together with a gelatin protection layer on a triacetyl cellulose film support by a simultaneous extrusion method to obtain specimens 1 to 8.

After exposing the specimens under an optical wedge just after the coating by using a xenon light source (1/1000 sec), they were developed at 35° C. for 20 min using Kodak preparation D-19 developer, and usual stopping and fixing were conducted. The densities of the processed specimens were measured and the sensitivity was indicated by a reciprocal number of an exposure amount required for obtaining an optical density of fogging +0.2 assuming the density in not exposed area as fogging and the sensitivity was indicated as a relative value based on the sensitivity of specimen 2 being assumed as 100.

Further, after storing coated specimens in an atmosphere at 50° C. and 75% RH for 3 days, identical exposure and development were conducted.

Further, the conversion of sodium thiosulfate in each of the emulsions ripened under the same condition was measured by a tracer method using sodium thiosulfate labeled with radioisotope 35S and they were shown collectively in Table 1.

TABLE 1

| | | | | | Just after Coating | | After Storage for 3 days at 50° C., 75% RH | | | |
|---|---|---|---|---|---|---|---|---|---|---|
| Specimen No. | Emulsion No. | pAg | Chlorauric acid (mol/molAg) | Na thiosulfate (mol/molAg) | Fogging | Relative Sensitivity | Fogging | Relative Sensitivity | Conversion of Na Thiosulfate | Remarks |
| 1 | 1 | 7.5 | — | — | 0.04 | 14 | 0.04 | 12 | — | Comp. Example |
| 2 | 2 | " | — | $1 \times 10^{-3}$ | 0.04 | 100 | 0.08 | 158 | 8 | Comp. Example |
| 3 | 3 | " | — | $4 \times 10^{-4}$ | 0.04 | 62 | 0.05 | 95 | 8 | Comp. Example |
| 4 | 4 | 6.5 | — | $7 \times 10^{-4}$ | 0.04 | 380 | 0.04 | 391 | 72 | Example |
| 5 | 5 | 5.5 | — | $5 \times 10^{-4}$ | 0.04 | 708 | 0.04 | 710 | 88 | " |
| 6 | 6 | 4.5 | — | $4 \times 10^{-4}$ | 0.04 | 731 | 0.04 | 721 | 85 | " |
| 7 | 7 | 7.5 | $3 \times 10^{-4}$ | $8 \times 10^{-4}$ | 0.04 | 590 | 0.04 | 621 | 32 | Comp Example |
| 8 | 8 | 5.5 | $2 \times 10^{-4}$ | $4 \times 10^{-4}$ | 0.04 | 822 | 0.04 | 832 | 85 | Comp Example |

As is apparent from Table 1, the sensitivity of silver iodide emulsions was considerably increased as has been already known when sulfur-sensitized with sodium thiosulfate at pAg of 7.5. However, they were sensitized further intensely in the pAg region as disclosed in the invention. It was an unexpected result. Further, when stored under high temperature and high humidity, while emulsions 2 and 3 showed remarkable change of sensitivity (increase), the change was vary small in the emulsions according to the invention and thus preferable. Further, also in gold/sulfur sensitization, the present invention showed extremely great increase in the sensitivity. When the conversion of sodium thiosulfate was measured, the conversion was extremely low and most of the portion was remained unreacted in emulsions 2 and 3 of comparative examples, whereas most of the portions was reacted in emulsions according to the invention. It is supposed that this well demonstrates that the shelf stability was improved remarkably and the addition amount of the sulfur sensitizer required for the optical sensitization may be decreased according to the invention.

According to the invention, a chalcogen sensitizer can be used up effectively in the silver emulsion high in silver iodide content to obtain photographic emulsions with high sensitivity and good shelf stability.

Example 2

In the same manner as in Example 1, silver iodide emulsions were prepared except for the change of the temperature of the reaction vessel to 33° C., of the silver potential to +10 mV and of the addition time for silver nitrate and potassium iodide to 60 min. Then, desalination and, water washing were conducted by a ultrafiltration method and after dissolving gelatin additionally, pH was adjusted to 5.9 and pAg was adjusted to 7.5. The obtained silver iodide grains had an average size of 42 nm and the variation coefficient of the grain size was 19%.

After dispensing the emulsion into 10 portions and elevating the temperature to 54° C., and after controlling the pAg for each of them as shown in Table 2, tellurium sensitizer (bis(N-phenyl-N-methyl carbamoyl) telluride), selenium sensitizer (pentafluorophenyl-triphenyl phosphine selenide), sulfur sensitizer (sodium thiosulfate) and, optionally, a reduction sensitizer (dimethylamine borane, simply referred to as DMAB) were added and ripened for 30 min. Then, pAg for each of the emulsions was adjusted to 6.0 to prepare emulsions 11 to 20.

Coating specimens were prepared in the same manner, exposed in the same manner as in Example 1 and then developed by a developer of the following prescription at 38° C. for 20 min to obtain the result of Table 2.

[Prescription of Developer]

| | |
|---|---|
| Sodium hydrogen sulfite | 5 g |
| Pyrogallol | 10 g |
| Sodium sulfite | 25 g |
| Sodium carbonate monohydrate | 50 g |
| KI | 0.1 g |

-continued

| | |
|---|---|
| 10% formalin solution | 25 cc |
| Made up with water to | 1 liter |

Further, the conversion of the chalcogen sensitizer was measured by a tracer method (by sulfur), or atomic absorption spectrometry (selenium, tellurium) and the result is shown in Table 2.

TABLE 2

| Specimen No. | Emulsion No. | pAg | Chemical Sensitizer (mol/molAg) | Just after Coating Fogging | Just after Coating Relative Sensitivity | Conversion of Chalcogen Sensitizer (%) | Remarks |
|---|---|---|---|---|---|---|---|
| 11 | 11 | 7.5 | — | 0.03 | 21 | — | Comp. Example |
| 12 | 12 | " | Te ($1 \times 10^{-3}$) | 0.03 | 100 | 16 | Comp. Example |
| 13 | 13 | 6.5 | Te ($7 \times 10^{-4}$) | 0.03 | 265 | 86 | Example |
| 14 | 14 | 5.5 | Te ($5 \times 10^{-4}$) | 0.03 | 281 | 100 | Example |
| 15 | 15 | 7.5 | Te ($1 \times 10^{-3}$) + DMAB ($8 \times 10^{-6}$) | 0.04 | 124 | 16 | Comp. Example |
| 16 | 16 | 5.5 | Te ($5 \times 10^{-4}$) + DMAB ($2 \times 10^{-6}$) | 0.04 | 321 | 100 | Example |
| 17 | 17 | 7.5 | Se ($1 \times 10^{-3}$) | 0.05 | 71 | 28 | Comp. Example |
| 18 | 18 | 5.5 | Se ($5 \times 10^{-4}$) | 0.04 | 175 | 84 | Example |
| 19 | 19 | 7.5 | S ($4 \times 10^{-3}$) | 0.03 | 43 | 6 | Comp. Example |
| 20 | 20 | 5.5 | S ($1.2 \times 10^{-3}$) | 0.03 | 120 | 85 | Example |

As is apparent from Table 2, the sensitivity of the silver iodide emulsions chemically sensitized with sulfur, tellurium or selenium sensitizer was increased also at pAg 7.5. However, when the addition amount shown in Table 2 was further increased, no further increase in the sensitivity was obtained. However, in the pAg region recited in the invention, sensitivity was further increased with a smaller addition amount. In the same manner as in Example 1, the conversion of sulfur, tellurium or selenium sensitizer was low in comparative emulsions and a great amount was left unreacted, whereas most of the portions were reacted in the emulsions according to the invention. It has been found for the first time according to the invention that the sulfur, tellurium or selenium sensitizers can be used up effectively in the silver emulsion high in silver iodide content to obtain photographic emulsions having high sensitivity. Further, when the reduction sensitization is used in combination with the emulsions according to the invention, a further increase in the sensitivity was obtained.

Example 3

1. Preparation of PET Support and Undercoating

1-1. Film Preparation

Using terephthalic acid and ethylene glycol, PET having an intrinsic viscosity: IV=0.66 (measured in phenol/tetrachloroethane=6/4 (weight ratio) at 25° C.) was obtained in accordance with an ordinary method. After pelleting the same, it was dried at 130° C. for 4 hours, melted at 300° C. and incorporated with 0.04 wt % of a dye BB of the following structure. Then, it was extruded from a T-die and quenched to prepare a unstretched film having a thickness of 175 μm after heat fixing.

Dye BB

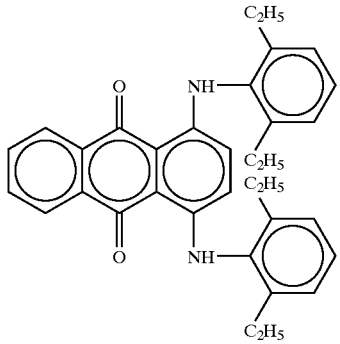

Then, it was stretched longitudinally by 3.3 times using rolls having different peripheral speeds and then laterally stretched by 4.5 times by a tenter. The temperature in this process was 110° C. and 130° C., respectively. Then, after heat fixing at 240° C. for 20 sec, it was relaxed by 4% at the same temperature in the lateral direction. Then, after slitting the chuck portion of the tenter, both ends were knurled, and taken up at 4 kg/cm$^2$ to obtain a roll having 175 $\mu$m thickness.

1-2. Surface Corona Treatment

The both surfaces of the support was corona treated using a solid state corona treating machine model 6 KVA manufactured by PILLAR Co., at 20 m/min under a room temperature. Based on the read values of the current and the voltage, it was found that treatment at 0.375 kV·A·min/m$^2$ was applied to the support. In this process, the treating frequency was at 9.6 kHz and a gap clearance between the electrode and the dielectric roll was 1.6 mm.

1-3. Undercoating

Preparation of an Undercoat Layer Coating Solution

| | |
|---|---|
| Prescription (1) (for undercoat layer on the side of photosensitive layer) | |
| PESRESIN A-520 (30% by mass solution) manufactured by Takamatsu Oil & FAT Co., Ltd. | 59 g |
| Polyethylene glycol mononononylphenyl ether (average ethylene oxide number = 8.5) 10% by mass solution | 5.4 g |
| MP-1000 (fine polymer particles, average particle size 0.4 $\mu$m) manufactured by Soken Chemical Co. | 0.91 g |
| Distilled water | 935 ml |
| Prescription (2) (First layer on the back surface) | |
| Styrene-butadiene copolymer latex (solid content 40% by mass, styrene/butadiene weight ratio = 68/32) | 158 g |
| Sodium 2,4-dichloro-6-hydroxy-5-triazine 8% by mass aqueous solution | 20 g |
| Sodium lauryl benzene sulfonate 1% by mass aqueous solution | 10 ml |
| Distilled water | 854 ml |
| Prescription (3) (Second layer on the back surface) | |
| $SnO_2$/SbO (9/1 mass ratio, average particle size 0.038 $\mu$m, 17% by mass dispersion) | 84 g |
| Gelatin (10% by mass aqueous solution) | 89.2 g |
| METROSE TC-5 (2% by mass aqueous solution) manufactured by Shinetsu Chemical Co. | 8.6 g |
| MP-1000 manufactured by Soken Chemical Co. | 0.01 g |
| Sodium docecylbenzene sulfonate 1% by mass aqueous solution | 10 ml |
| NaOH (1% by mass) | 6 ml |
| Proxell manufactured by ICI Co. | 1 ml |
| Distilled water | 805 ml |

(2) Undercoating

After applying the corona discharging treatment described above to each of the both faces of the biaxially stretched polyethylene terephthlate support having 175 $\mu$m thickness, the undercoat coating solution prescription (1) described above was coated on one surface (surface for photosensitive layer) by a wire bar to provide a wet coating amount of 6.6 ml/m$^2$ (per one surface), and then dried at 180° for 5 min, then, the undercoat coating solution prescription (2) described above was coated to the rear face (back surface) thereof by a wire bar to provide a wet coating amount of 5.7 ml/m$^2$ and dried at 180° C. for 5 min. Further, the undercoat coating solution prescription (3) described above was coated on the rearface (back surface) by a wire bar to provide a wet coating amount of 7.7 ml/m$^2$ and dried at 180° C. for 6 min to prepare an undercoated support.

2. Back Layer 2-1. Preparation of Back Layer Coating Solution (1) Preparation of Fine Solid Particle Liquid Dispersion (a) of a Base precursor.

64 g of base precursor compound-1, 10 g of DEMOL N (trade name of products from Kao Co), 28 g of diphenylsulfone and 220 ml of distilled water were added and mixed and a liquid mixture was subjected to beads dispersion by ¼G sand grinder mill (manufactured by IMEX Co.) to obtain a fine solid particle dispersion (a) of a base precursor compound having an average particle size of 0.2 $\mu$m.

(2) Preparation Offine Solid Dye Particle Dispersion (a)

9.6 g of cyanine dye compound-1, 5.8 g of sodium p-dodecyl sulfonate and 305 ml of distilled water were mixed and the liquid mixture was subjected to beads dispersion by ¼G sand grinder mill (manufactured by IMEX Co.) to obtain a fine solid dye particle dispersion (a) having an average particle size of 0.2 $\mu$m.

(3) Preparation of Anti-Halation Layer Coating Solution 17 g of gelatin, 9.6 g of polyacrylamide, 70 g of the fine solid particle dispersion (a) of the base precursor, 56 g of the fine solid dye particle dispersion (a), 1.5 g of monodispersed fine polymethyl methacrylate particles (average particle size 8 $\mu$m, particle size standard deviation 0.4), 0.03 g of benzoisothiazolinone, 2.2 g of sodium polyethylene sulfonate, 0.2 g of blue dye compound-1, 3.9 g of a yellow dye compound-1 and 844 ml of water were mixed to prepare an anti-halation coating solution.

(4) Preparation of Coating Solution for Back Surface Protection Layer

A vessel was kept at 40° C., in which 50 g of gelatin, 0.2 g of sodium polystyrene sulfonate, 2.4 g of N,N-ethylene bis(vinylsulfone acetamide), 1 g of sodium t-octyl phenoxyethoxy ethane sulfonate, 30 mg of benzoisothiazolinone, 37 mg of a fluorine type surfactant (F-1), 0.15 g of fluorine type surfactant (F-2), 64 mg of a fluorine type surfactant (F-3), 32 mg of fluorine type surfactant (F-4), 8.8 g of an acrylic acid/ethylacrylate copolymer (copolymer weight ratio 5/95), 0.6 g of aerosol OT (manufactured by American Cyanamide Co.), 1.8 g of liquid paraffin in the form of a liquid paraffin emulsion and 950 ml of water were mixed to prepare a coating solution for protecting layer of the back surface.

2-2. Coating of Back Layer

On the back surface of the undercoated support, an anti-halation layer coating solution and a coating solution for the back surface protection layer were simultaneously coated in double layer such that the coating amount of the fine solid dye particles, which was contained in the anti-halation layer coating solution, was 0.04 g and the coating amount of the gelatin, which was contained in the coating solution for back surface protection layer, was 1.7 g/m$^2$, and dried to prepare a back layer.

3. Image Forming Layer, Intermediate Layer and Surface Protection Layer 3-1 Preparation of Coating Material (1) Silver Halide Emulsion

[Preparation of Silver Halide Emulsion]

A solution formed by adding 4.3 ml of 1% by mass potassium iodide solution to 1420 ml of distilled water and further adding 3.5 ml of sulfuric acid at 0.5 mol/l concentration and 36.7 g of phthalic-acid-substituted gelatin was kept in a stainless steel reaction pot at a liquid temperature of 35° C. being stirred. Solution A in which 22.22 g of silver nitrate was diluted with distilled water to give a volume of 195.6 ml and solution B in which 21.8 g of potassium iodide was diluted with distilled water to give a volume of 219 ml were added to the solution at a constant flow rate in 9 minutes. Then, 10 ml of 3.5% by mass aqueous solution of hydrogen peroxide was added to the mixture and 10.8 ml of 10% by mass aqueous solution of benzoimidazole was further added. Further, solution C in which 51.86 g of silver nitrate was diluted with distilled water to give a volume of 317.5 ml and a solution D in which 60 g of potassium iodide was diluted with distilled water to give a volume of 600 ml were added, wherein an entire amount of the solution C was added at a constant flow rate in 120 min and the solution D was added by a controlled double jet method while keeping pAg at 8.1.

Potassium hexachloro iridate (III) was added to the mixture to give the concentration of $1\times10^{-4}$ mol per one mol of silver in the mixture, wherein the entire amount was added 10 min after the starting of the addition of the solution C and the solution D. Further, an aqueous solution of potassium hexacyano ferrate (II) was added by $3\times10^{-4}$ mol per one mol of silver, wherein the entire amount was added 5 see after the completion of addition of solution C. pH of the mixture was adjusted to 3.8 using sulfuric acid at 0.5 mol/L concentration, stirring was stopped and sedimentation/desalination/water washing steps were conducted. pH was adjusted to 5.9 using sodium hydroxide at 1 mol/L concentration to prepare a silver halide dispersion with pAg of 8.0. The grains in the silver halide emulsion thus prepared were pure silver iodide grains with an average sphere equivalent diameter of 0.037 μm and sphere equivalent diameter variation coefficient of 17%. The grain size and the like were determined based on average of 1000 grains by using an electron microscope.

The silver halide dispersion was dispensed into 7 portions, each of them was kept at 38° C. being stirred, 5 ml of 0.34% by mass methanol solution of 1,2-benzoisothiazoline-3-one was added. 40 min later, a methanol solution of spectral sensitizing dye A and sensitizing dye B at a molar ratio of 1:1 was added by $1.2\times10^{-3}$ mol as a total of the sensitizing dyes A and B based on one mol of silver. Then the temperature was elevated to 47° C. after 1 min. 20 min after the temperature elevation, sodium benzene thiosulfonate in the form of a methanol solution was added by $7.6\times10^{-5}$ mol based on one mol of silver and pAg was adjusted to the values shown in Table 3. 5 min after adjustment of pAg, a sulfur sensitizer (sodium thiosulfate), a selenium sensitizer (pentafluorophenyl triphenyl phosphine selenide), and a tellurium sensitizer C (bis(N-phenyl-N-methyl carbamoyl) telluride) each shown in Table 3 were added and each mixture was ripened for 84 min. The addition amount of each is shown in Table 3

Then, after adjusting pAg of each of the emulsions to 7.5, 1.3 ml of 0.8% by mass methanol solution of N,N'-dihydroxy-N"-diethylmelamine was added and, further 4 min after, 5-methyl-2-mercaptobenzoimidazole in a methanol solution state was added in an amount of $4.8\times10^{-8}$ mol based on one mol of silver and 1-phenyl-2-heptyl-5-mercapto-1,3,4-triazole in a methanol solution state was added in an amount of $5.4\times10^{3}$ mol based on one mol of silver to prepare silver halide emulsions 21 to 27.

[Preparation of Mixed Emulsion for Coating Solution]

Each of the silver halide emulsions described above was dissolved and benzotiazolium iodide was added in the form of 1% by mass aqueous solution in an amount of $7\times10^{-3}$ mol based on one mol of silver. Further, water was added such that the content of silver halide was 38.2 g as silver form based on 1 kg of the mixed emulsion for coating liquid.

(2) Preparation of Silver Fatty Acid Dispersion (A)

87.6 kg of behenic acid manufactured by Henkel Co. (trade name of product: Edenor C 22-R), 423 L of distilled water, 49.2 L of 5 mol/L NaOH solution and 120 L of t-butyl alcohol were mixed and reacted, being stirred, at 75° C. for one hour to obtain a sodium behenate solution. Separately, 206.2 L of an aqueous solution of 40.4 kg of silver nitrate (pH 4.0) was provided and kept at a temperature of 10° C. A reaction vessel containing 635 L of distilled water and 30 L of t-butyl alcohol was kept at a temperature of 30° C., and the entire amount of the sodium behenate solution and the entire amount of the aqueous solution of the silver nitrate were added with sufficient stirring, each at a constant flow rate for 93 min and 15 sec and 90 min, respectively.

In the addition, only the aqueous solution of silver nitrate was added for 11 min after starting the addition of the aqueous solution of silver nitrate, then the addition of sodium behenate solution was started, and only the sodium behenate solution was added for 14 min and 15 see after the completion of the addition of the aqueous solution of silver nitrate. In the addition, the temperature inside the reaction vessel was kept at 30° C. and the external temperature was controlled such that the liquid temperature was constant.

Further, pipelines of the addition system for the sodium behenate solution was kept warm by circulating warm water on the outside of a double walled pipe and the circulation was controlled such that the liquid temperature at the exit of the addition nozzle top was 75° C. Further, the temperature of the pipelines of the addition system for the aqueous solution of the silver nitrate was kept by circulating cold water on the outside of the double-walled pipe. The addition position of the sodium behenate solution and the addition position of the aqueous solution of silver nitrate were arranged symmetrically with respect to the stirring axis as a center and adjusted to such a height so as not in contact with the reaction solution.

After the completion of the addition of the sodium behenate solution, the mixture was stirred and left for 20 min at the temperature as it was and then the temperature was elevated to 35° C. taking 30 min and then ripening was conducted for 210 min. Just after the completion of the ripening, solid contents were separated by centrifugal filtration and the solids were water-washed such that the conductivity of the filtered water became 30 μS/cm. Thus, silver fatty acid salt was obtained. The obtained solids were stored in the form of wet cakes without drying.

When the form of the obtained silver behenate grains was evaluated by electron microscopic photography, a=0.14 μm, b=0.4 μm, c=0.6 μm in an average value and an average aspect ratio was 5.2 (a, b, c are as defined in the specification). As a result of measurement by a laser beam scattering type grain size measuring apparatus, they were scaly crystals with a variation coefficient of 15% and an average sphere equivalent diameter of 0.52 μm.

19.3 kg of polyvinyl alcohol (trade name of products: PVA-217) and water were added to wet cakes corresponding to 260 kg of dry solids to make the entire amount to 1,000 kg, which were then slurried by dissolver blades and, further, pre-dispersed by a pipeline mixer (Model PM-10 manufactured by Mizuho Industry Co.).

Then, a stock solution after the pre-dispersion was treated for three times by a dispersing machine (trade name; Micro Fluidizer M-610, manufactured by MicroFluidex International Corp., using Z-type interaction chamber) while controlling the pressure of the dispersing machine at 1260 kg/cm$^2$, to obtain silver fatty acid salt dispersion A. For the cooling operation, coiled heat exchangers were mounted before and after the interaction chamber, respectively, and the dispersion temperature was set at 18° C. by controlling the temperature of a cryogenic liquid.

(3) Preparation of Reducing Agent Dispersion A 7.2 kg of water was added to 10 kg of reducing agent complex-1, 0.12 kg of hydrogen bonding compound-1 and 16 kg of an aqueous 10% by mass solution of a modified polyvinyl alcohol (Poval MP203, manufactured by Kuraray Co.) and mixed thoroughly to prepare a slurry. The slurry was fed by a diaphragm pump to a horizontal type sand mill (UVM-2: manufactured by IMEX Co.) filled with zirconia beads having an average diameter of 0.5 mm, and after dispersion by the horizontal type sand mill for 4 hours and 30 min, then 0.2 g of sodium benzoisothiazolinone and water were added to prepare reducing agent dispersion A, in which the concentration of the reducing agent complex was 25% by mass.

The thus obtained reducing agent complex particles in the dispersion had an average particle size of 0.46 μm as a median diameter and a maximum particle size of 1.6 μm or less. The obtained dispersion was filtered through a polypropylene filter having a pore size of 3.0 μm to remove obstacles such as dusts and stored.

(4) Preparation of Polyhalogen Compound Dispersion

[Organic Polyhalogen Compound-1 Dispersion]

10 kg of organic polyhalogen compound-1, 10 kg of 20% by mass aqueous solution of modified polyvinyl alcohol MP203, 0.4 kg of 20% by mass aqueous solution of sodium triisopropyl naphthalene sulfonate and 14 kg of water were added and mixed thoroughly to form a slurry.

The slurry was fed by a diaphragm pump and dispersed by a horizontal type sand mill (UVM-2: manufactured by IMEX Co.) filled with zirconia beads having an average diameter of 0.5 mm for 5 hours as a basic time and then 0.2 g of sodium benzoisothiazolinone and water were added so that the concentration of the organic polyhalogen compound became 26% by mass, to obtain a polyhalogen compound-1 dispersion.

The thus obtained organic trihalogen compound particles in the dispersion had an average particle size of 0.41 μm as a median diameter and a maximum particle size of 2.0 μm or less. The obtained organic trihalogen compound dispersion was filtered through a polypropylene filter having a pore size of 10.0 μm to remove obstacles such as dusts and stored.

[Organic Polyhalogen Compound-2 Dispersion]

10 kg of an organic polyhalogen compound-2, 20 kg of 10% by mass aqueous solution of modified polyvinyl alcohol MP203, and 0.4 kg of 20% by mass aqueous solution of sodium triisopropyl naphthalene sulfonate were added and mixed thoroughly to form a slurry.

The slurry was fed by a diaphragm pump and dispersed by a horizontal type sand mill (UVM-2: manufactured by IMEX Co.) filled with zirconia beads having an average diameter of 0.5 mm for 5 hours and then 0.2 g of sodium benzoisothiazolinone and water were added so that the concentration of the organic polyhalogen compound became 25% by mass. The dispersion was heated at 40° C. for 5 hours to obtain a polyhalogen compound-2 dispersion.

The thus obtained organic polyhalogen compound particles in the dispersion had an average particle size of 0.36 μm as a median diameter and a maximum particle size of 1.5 μm or less. The obtained organic polyhalogen compound dispersion was filtered through a polypropylene filter having a pore size of 3.0 μm to remove obstacles such as dusts and stored.

(5) Preparation of Phthalazine Compound-1 Solution 8 kg of modified polyvinyl alcohol MP 203 was dissolved in 174.57 kg of water and then 3.15 kg of an 20% by mass aqueous solution of sodium triisopropyl naphthalene sulfonate and 14.28 kg of an 70% by mass aqueous solution of phthalazine compound-1 were added to prepare 5% by mass solution of phthalazine compound-1.

(6) Preparation of Mercapto Compound-1 Aqueous Solution 7 g of mercapto compound-1 was dissolved in 993 g of water to form 0.7% by mass aqueous solution.

(7) Preparation of Pigment-1 Dispersion 250 g of water was added to 64 g of C.I. Pigment Blue 60 and 6.4 g of DEMOL N and they were mixed thoroughly to form slurry. 800 g of zirconia beads having an average diameter of 0.5 mm was charged together with the slurry into a vessel and, after dispersion by a ¼ G sand grinder mill (manufactured by IMEX Co.) for 25 hours, water was added to dilute the dispersion such that the pigment concentrations became 5% by mass. The average particle size of the pigment in the obtained dispersion was 0.21 μm.

(8) Preparation of SBR Latex Liquid

An SBR latex (Tg=23° C.) was prepared as described below. After emulsion polymerization of 70.5 mass parts of styrene, 26.5 mass parts of butadiene and 3.0 mass parts of acrylic acid by using ammonium persulfate as a polymerization initiator and an anionic surfactant as an emulsifier, the polymer was ripened at 80° C. for 8 hours. Then, the product was cooled to 40° C. and adjusted to pH 7.0 by aqueous ammonia. Further, Sunded BL manufactured by Sanyo Kasei Co. was added to give the concentration of 0.22%. Then, 5% solution of aqueous sodium hydroxide was added to set pH at 8.3 and, further, to pH 8.4 with aqueous ammonia. The molar ratio of $Na^+$ ions to $NH^{4+}$ ions used in this case was 1:2.3. Further, 0.15 ml of an 7% aqueous solution of sodium benzoisothiazolinone was added per 1 kg of the mixture to prepare an SBR latex liquid.

(SBR Latex: Latex of St(70.0)-Bu(27.0)-AA(3.0))

Tg 23° C., average particle size 0.1 μm, concentration at 43% by mass, equilibrium moisture content 0.6% by mass at 25° C., 60% RH, ionic conductivity 4.2 ms/cm (ionic conductivity was measured by using conductivity meter CM-30S manufactured by Toa Denpa Industry Co. for latex stock solution (43% by mass) at 25° C.), pH 8.4.

3-2) Preparation of Coating Solution

Preparation of Coating Solution for Image Forming Layer-1

1,000 g of the fatty acid silver salt dispersion A obtained as described above, 104 ml of water, 30 g of the pigment-1 dispersion, 6.3 g of the organic polyhalogen compound-1 dispersion, 20.7 g of the organic polyhalogen compound-2 dispersion, 173 g of the phthalazine compound-1 solution, 1082 g of SBR latex (Tg: 23° C.) liquid, 258 g of the reducing agent dispersion A and 9 ml of the aqueous solution of mercapto compound-1 were added successively, and 117 g of the emulsion mixture of silver halide for the coating liquid was added just before coating and mixed thoroughly to form an emulsion layer coating liquid, which was fed, as it was, to a coating dye and coated.

When the viscosity of the emulsion layer coating liquid was measured by B-type viscometer manufactured by Tokyo Kei, it was 25 [mPa·S] at 40° C. (No. 1 rotor, 60 rpm).

2) Preparation of Intermediate Layer Coating Solution 2 ml of an 5% by mass aqueous solution of aerosol OT and 10.5 ml of 20% by mass aqueous solution of diammonium phthalate were added to 772 g of an 10% by mass aqueous solution of polyvinyl alcohol PVA-205 (manufactured by Kuraray Co.), 5.3 g of pigment-1 dispersion, and 226 g of a 27.5% by mass solution of methylmethacrylate/styrene/butyl acrylate/hydroxyethyl methacrylate/acrylic acid copolymer (copolymerization weight ratio 64/9/20/5/2) latex, and water was added such that the total amount became 880 g, in which pH was set to 7.5 with NaOH to form an intermediate layer coating liquid and fed to a coating die to be coated in the thickness of 10 ml/m$^2$.

The viscosity of the coating liquid was 65 [mPa·S] when measured by a B-type viscometer at 40° C. (No. 1 rotor, 60 rpm).

(3) Preparation of the Coating Liquid for the Surface Protection First Layer 64 g of inert gelatin was dissolved in water, and 80 g of 27.5% by mass liquid of methyl methacrylate/styrene/butyl acrylate/hydroxyethyl methacrylate/acrylic acid copolymer (copolymerization weight ratio 64/9/20/5/2) latex, 23 ml of 10% by mass methanol solution of phthalic acid, 23 ml of 10% by mass aqueous solution of 4-methyl phthalic acid, 28 ml of sulfuric acid at 0.5 mol/L concentration, 5 ml of 5% by mass aqueous solution of aerosol OT, 0.5 g of phenoxyethanol and 0.1 g of benzoisothiazolinone were added and water was added so that the total amount became 750 g to form a coating liquid, and 26 ml of 4% by mass chrome alum was mixed to the coating liquid just before coating by a static mixer, then the coating liquid was fed to a coating dye to be coated in a thickness of 18.6 ml/m$^2$.

The viscosity of the coating liquid was 20 [mPa·S] when measured by a B-type viscometer at 40° C. (No. 1 rotor, 60 rpm).

(4) Preparation of a Surface Protection Second Layer Coating Liquid 80 g of inert gelatin was dissolved in water, and 102 g of a 27.5% by mass liquid of methyl methacrylate/styrene/butyl acrylate/hydroxyethyl methacrylate/acrylic acid copolymer (copolymerization weight ratio 64/9/20/5/2) latex, 3.2 ml of an aqueous 5% by mass solution of a fluorine type surfactant F-1, 32 ml of an aqueous 2% by mass solution of a fluorine type surfactant F-2, 23 ml of an aqueous 5% by mass solution of aerosol OT, 4 g of polymethyl metacrylate particles (average particle size of 0.7 μm), 21 g of fine polymethyl methacrylate particles (average particle size of 4.5 μm), 1.6 g of 4-methylphthalic acid, 4.8 g of phthalic acid, 44 ml of sulfuric acid at 0.5 mol/l concentration, and 10 mg of benzoisothiazolinone were added and water was added to increase the total amount to 650 g, and 445 ml of aqueous solution containing 4% by mass of chrome alum and 0.67% by mass of phthalic acid was mixed to the coating liquid just before coating by a static mixer, and the coating liquid was fed to a coating dye to be coated in a thickness of 8.3 ml/m$^2$.

The viscosity of the coating liquid was 9 [mPa·S] when measured by a B-type viscometer at 40° C. (No. 1 rotor, 60 rpm).

3-3) Preparation of Coating Sample

An image forming layer, an intermediate layer, a surface protection first layer, and a surface protection second layer were simultaneously multilayer-coated in this order on an undercoat layer on the surface opposite to the back surface by a slide bead coating method to prepare a specimen of a thermally developable photosensitive material. The temperature of the coating solution was controlled at 35° C. for the image forming layer and the intermediate layer, at 36° C. for the protection first layer, and at 37° C. for the protection second layer.

The coating amount (g/m$^2$) of each of the compounds in the emulsion layer is as described below.

| | |
|---|---|
| Silver behenate | 6.19 |
| C.I. Pigment Blue 60 | 0.036 |
| Organic polyhalogen compound-1 | 0.04 |
| Organic polyhalogen compound-2 | 0.12 |
| Phthalazine compound-1 | 0.21 |
| SBR latex | 11.1 |
| Reducing agent complex-1 | 1.54 |
| Mercapto compound-1 | 0.002 |
| Silver halide (as Ag) | 0.10 |

Coating and drying conditions are as shown below.

Coating was conducted at a speed of 160 m/min, the gap between the coating die top end and the support was set to 0.10 to 0.30 mm, and the pressure in a reduced pressure chamber was set lower than an atmospheric pressure by 196 to 882 Pa. The support was static-eliminated by an ionic flow before coating.

In a succeeding chilling zone, the coated liquid was cooled by a blow having a dry bulb temperature of 10 to 20° C. and then it was conveyed in a non-contact manner, and dried in a helical non-contact type drying apparatus, by a dry blow having a dry bulb temperature of 23-45° C. and a wet bulb temperature of 15 to 21° C.

After drying, the film surface was heated to 70 to 90° C. after controlling the humidity in an atmosphere of 40 to 60% RH at 25° C. After heating, the film surface was cooled down to 25° C.

The degree of matte of the prepared thermally developable photosensitive material, according to Beck smoothness, was 550 see on the side of the image forming layer and 130 sec at the back surface. Further, pH on the film surface on the side of the image forming layer was measured and the pH was 6.0.

Chemical structures of the compounds used in the examples according to the invention are shown below.

Spectral sensitizing dye A

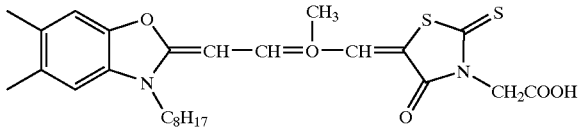

Spectral sensitizing dye B

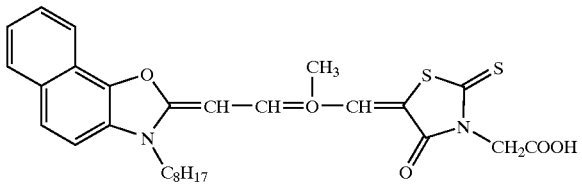

-continued
Tellurium sensitizer C
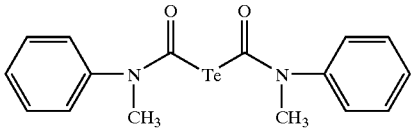
Base precursor compound-1
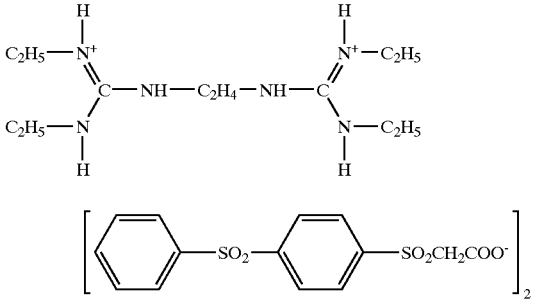
Cyanine dye compound-1
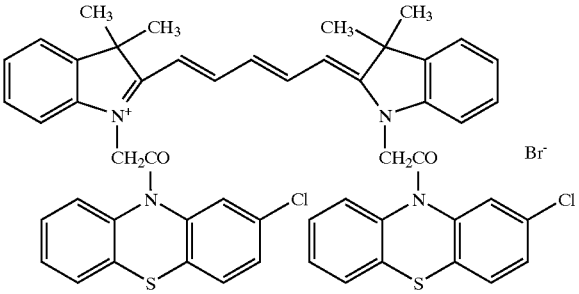
Blue dye compound-1
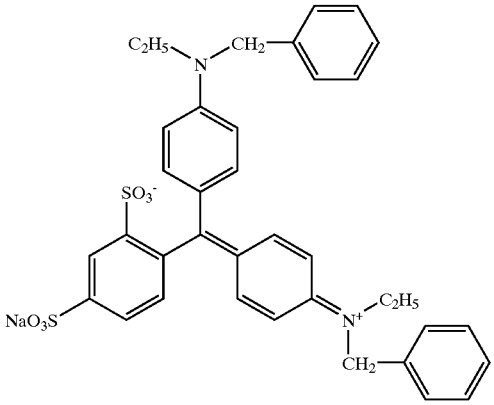
Yellow dye compound-1
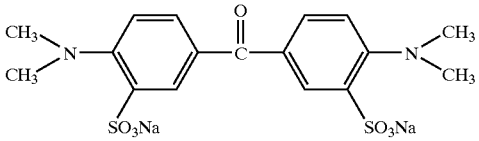
-continued
Reducing agent 1
1:1 complex of
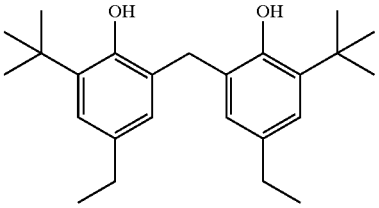
and
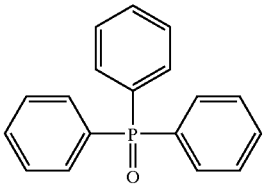
Reducing agent 2
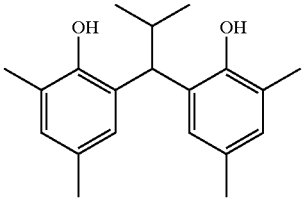
Reducing agent 3
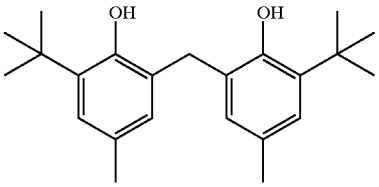
Hydrogen bonding compound 1
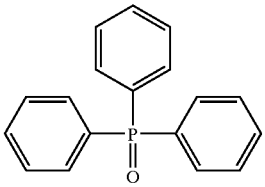
Hydrogen bonding compound 2
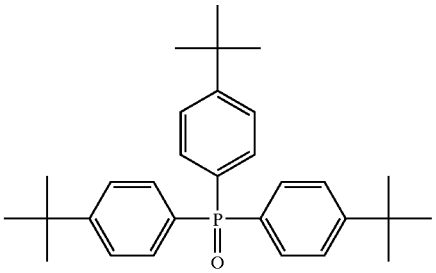
Polyhalogen compound-1
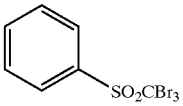
Polyhalogen compound-2
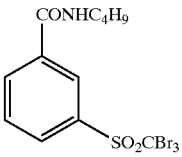

-continued

Mercapto compound-2

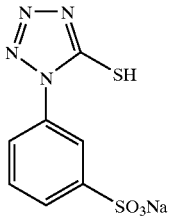

Phthalazine compound-1

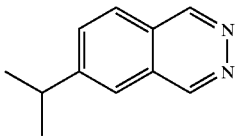

Development accelerator-1

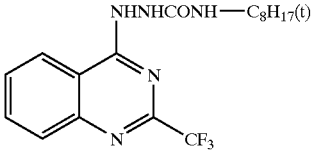

(F-1)

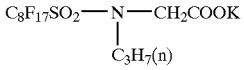

(F-2)

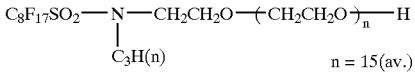

n = 15(av.)

(F-3)

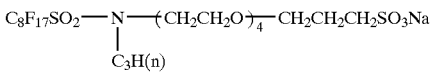

(F-4)

4. Evaluation for Photographic Performance

[Preparation]

The obtained specimen was cut into a half size, packed in a packaging material under the condition that the temperature is 25° C. and the humidity is 50% RH, and stored for 2 weeks at a normal temperature (packaging material).

50 μm polyethylene containing PET 10 μm/PE 12 μm/aluminum foil 9 μm/Ny 15 μm/carbon 3%, oxygen permeability: 0.02 ml/atm·m$^2$·25° C.·day, moisture permeability: 0.10 g/atm·m$^2$·25° C.·day.

The photosensitive material described above was evaluated as below.

(Exposure of Photosensitive Material)

The photosensitive materials were subjected to an exposure treatment as shown below.

Exposure and developing treatment were conducted using modified Fuji medical dry laser imager-FM-DPL. Upon exposure, 660 nm semiconductor laser beam having the maximum power of 60 mW (IIIB) mounted on FM-DPL was restricted to 100 μm×100 μm and the photosensitive material is irradiated. The exposure was conducted while changing the exposure amount of laser stepwise. Development was conducted by using a thermal developing section in FM-DPL with four sheets of panel heaters set at 112° C.-119° C.-121° C.-121° C. for 24 see in total.

(Evaluation of Specimen)

The density of the obtained image was measured by Macbeth densitometer to give a characteristic curve of the density relative to the logarithm of the exposure amount. Regarding the sensitivity, the optical density in the unexposed area was defined as fogging ($D_{min}$) and the density at the area exposed by the highest exposure amount was defined as $D_{max}$. Further, a reciprocal number of the exposure amount capable of obtaining an optical density of $D_{min}$+2.0 was defined as the sensitivity which was indicated by the relative value assuming the sensitivity of specimen 21 as 100. Larger value indicates higher sensitivity.

TABLE 3

| Specimen No. | Emulsion No. | pAg | Chalcogen sensitizer (mol/molAg) | $D_{min}$ | $D_{max}$ | Relative sensitivity | Remarks |
|---|---|---|---|---|---|---|---|
| 21 | 21 | 7.5 | — | 0.17 | 3.2 | 100 | Comp. Example |
| 22 | 22 | 7.5 | S ($5 \times 10^{-3}$) | 0.18 | 3.4 | 110 | Comp. Example |
| 23 | 23 | 4.5 | S ($1.4 \times 10^{-3}$) | 0.18 | 3.9 | 142 | Example |
| 24 | 24 | 7.5 | Te ($1.2 \times 10^{-3}$) | 0.18 | 3.6 | 126 | Comp. Example |
| 25 | 25 | 5.5 | Te ($5 \times 10^{-4}$) | 0.18 | 4.3 | 251 | Example |
| 26 | 26 | 7.5 | Se ($1.2 \times 10^{-3}$) | 0.18 | 3.6 | 124 | Comp. Example |
| 27 | 27 | 5.5 | Se ($5 \times 10^{-4}$) | 0.18 | 4.2 | 214 | Example |

As is apparent from the result of Table 3, while the sensitivity can be increased somewhat by chalcogen sensitization also in a known pAg region of 7.5, it was found that the sensitivity is remarkably increased with lower $D_{min}$, and high $D_{max}$ in the pAg region according to the invention. Particularly, selenium chemical sensitization and tellurium sensitization showed remarkable effect and, particularly, tellurium chemical sensitization showed excellent effect.

Example 4

A thermally developable photosensitive material was produced in the same manner as specimen 25 of Example 3, except for the use of the following compounds in place of the reducing agent complex.

(Preparation of Reducing Agent-2 Dispersion)

6 kg of water was added to 10 kg of reducing agent-2 and 20 kg of 10% by mass aqueous solution of modified polyvinyl alcohol MP203 and mixed thoroughly to prepare slurry. The slurry was fed by a diaphragm pump and dispersed by a horizontal type sand mill UVM-2 filled with zirconia beads having an average diameter of 0.5 mm for 3 hours and 30 min. After the dispersion, 0.2 g of sodium benzoisothiazolinone and water were added to set the concentration of the reducing agent to 25% by mass, to obtain a reducing agent-5 dispersion. The particles of the reducing agent contained in the thus obtained reducing agent dispersion had a median diameter of 0.38 μm, a maximum particle size of 1.5 μm or less. The obtained reducing agent dispersion was filtered by using a polypropylene filter with a pore size of 3.0 μm to remove obstacles such as dusts and stored.

(Preparation of Hydrogen Bonding Compound-2 Dispersion)

10 kg of water was added to 10 kg of a hydrogen bonding compound-2 and 20 kg of 10% by mass aqueous solution of modified polyvinyl alcohol MP203 and mixed thoroughly to form slurry. The slurry was fed by a diaphragm pump and dispersed by a horizontal type sand mill UVM-2 filled with zirconia beads having an average diameter of 0.5 mm for 3 hours and 30 min. After the dispersion, 0.2 g of sodium benzoisothiazolinone and water were added to set the concentration of the reducing agent to 22% by mass, to obtain a hydrogen bonding compound-2 dispersion. The particles of the hydrogen bonding compound contained in the thus obtained hydrogen bonding compound dispersion had a median diameter of 0.35 μm, a maximum particle size of 1.5 μm or less. The obtained hydrogen bonding compound dispersion was filtered by using a polypropylene filter having a pore size of 3.0 μm to remove obstacles such as dusts and stored.

(Preparation of Thermally Developable Photosensitive Material 28)

A thermally developable photosensitive material 28 was produced in the same manner as the production of the specimen 25 in Example 3 except for the use of the dispersion of a reducing agent-2 and dispersion of a hydrogen bonding compound-2 in place of the dispersion of the reducing agent complex-1. The coating amount ($g/m^2$) of each of the compounds in the emulsion layer is as shown below.

| | |
|---|---|
| Silver behenate | 6.0 |
| Reducing agent-2 | 0.76 |
| Hydrogen bonding compound-1 | 0.59 |
| Pigment (C.I. Pigment Blue 60) | 0.032 |
| Polyhalogen compound-1 | 0.04 |
| Polyhalogen compound-2 | 0.12 |
| Phthalazine compound-1 | 0.21 |
| SBR latex | 11.1 |
| Mercapto compound-1 | 0.002 |
| Silver halide (as Ag) | 0.09 |

As a result of evaluation conducted in the same manner as in Example 3, preferable results like those in Example 3 were obtained.

Example 5

A development photosensitive material 29 was produced by using a compound of the reducing agent-3 in place of the reducing agent-2 in Example 4 (dispersion was prepared in the same manner and added) and further adding the dispersion of the following development accelerator-1 in an amount that the content of the development accelerator became 0.01 $g/m^2$.

As a result of the developing treatment, in which the conveying speed of the thermal developing machine was changed to set the thermal developing time to 14 sec, preferable results like those in Example 3 were obtained.

(Preparation of Development Accelerator-1 Dispersion)

10 kg of water was added to 10 kg of a development accelerator-1, 20 kg of an 10% by mass aqueous solution of modified polyvinyl alcohol MP203 and mixed thoroughly to form a slurry. The slurry was fed by a diaphragm pump and after dispersion by a horizontal type sand mill UVM-2 filled with zirconia beads having an average diameter of 0.5 mm for 3 hours and 30 min. 0.2 g of sodium benzoisothiazolinone and water were added to set the concentration of the reducing agent to 20% by mass, to obtain a development accelerator-1 dispersion.

The particles of the development accelerator-1 contained in thus obtained development accelerator dispersion had a median diameter of 0.48 μm, and a maximum particle size of 1.4 μm or less. The obtained development accelerator dispersion was filtered by using a polypropylene filter having a pore size of 3.0 μm to remove obstacles such as dusts and stored.

Example 6

An emulsion 29 was prepared in the same manner as the preparation of the silver halide emulsion 25 in Example 3 except that the sensitizing dyes A and B were not added. And coating specimen 30 was obtained in the same manner as in Example 3. Subsequently, the exposure was conducted by using a blue laser beam of 405 nm and the same treatment as in the Example 3 was conducted, and preferable results like those in Example 3 were obtained.

Example 7

A silver bromo iodo chloride emulsion was prepared in the same manner as in the preparation of the silver iodide emulsion in Example 3 except that 6% of silver iodide and epitaxially formed 10% of silver chloride were added. And coating solution 31 was obtained in the same manner as the preparation of the emulsion 25 in Example 3. The same exposure and developing treatment was conducted as in Example 3, and favorable results as those in Example 3 were obtained.

The present invention can provide a high silver iodide photographic emulsion having high sensitivity and good shelf stability and, further, can provide a thermally developable photosensitive material having high sensitivity, low $D_{min}$, and high $D_{max}$ and excellent in image shelf stability to light irradiation after the treatment.

What is claimed is:

1. A silver halide photographic emulsion containing silver iodide in an amount of 80% by mol to 100% by mol, and chemically sensitized by at least one of a chalcogen sensitization method and a gold sensitization method under the condition that pAg is from 1.5 to 6.0.

2. A silver halide photographic emulsion according to claim 1, wherein the silver halide contains silver iodide in an amount of 90% by mol to 100% by mol.

3. A silver halide photographic emulsion according to claim 1, wherein a grain size of the silver halide is in a range of 5 nm to 70 nm.

4. A silver halide photographic emulsion according to claim 1, wherein grains of the photosensitive silver halide are formed and chemically sensitized under the condition that a non-photosensitive organic silver salt is not present.

5. A silver halide photographic emulsion according to claim 1, wherein the chalcogen sensitization is tellurium sensitization, selenium sensitization or sulfur sensitization.

6. A silver halide photographic emulsion according to claim 1, wherein the gold sensitization is gold chalcogen sensitization which is a combination of gold sensitization and chalcogen sensitization, and is selected from the group consisting of gold/sulfur sensitization, gold/tellurium sensitization, gold/sulfur/selenium sensitization, gold/sulfur/tellurium sensitization, gold/selenium/tellurium sensitization and gold/sulfur/tellurium sensitization.

7. A silver halide photographic emulsion according to claim 1, wherein reduction sensitization is further carried out in addition to the chalcogen sensitization or the gold sensitization.

8. A silver halide photographic emulsion according to claim 1, wherein exposure is conducted with laser beam.

9. A thermally developable photosensitive material having, disposed on it, at least one image forming layer comprising at least one kind of photosensitive silver halide, a non-photosensitive organic silver salt, a reducing agent and a binder on one surface of a support, wherein the photosensitive silver halide contains silver iodide in an amount of 80% by mol to 100% by mol, and is chemically sensitized by at least one of a chalcogen sensitization method or a gold sensitization method under the condition that pAg is from 1.5 to 6.0.

10. A thermally developable photosensitive material according to claim 9, wherein the photosensitive silver halide contains silver iodide in an amount of 90% by mol to 100% by mol.

11. A thermally developable photosensitive material according to claim 9, wherein a grain size of the silver halide is in a range of 5 nm to 70 nm.

12. A thermally developable photosensitive material according to claim 9, wherein a coating amount of the photosensitive silver halide grains is in a range of 0.5% by mol to 15% by mol based on the silver in the non-photosensitive organic silver salt.

13. A thermally developable photosensitive material according to claim 9, wherein grains of the photosensitive silver halide are formed and chemically sensitized under the condition that the non-photosensitive organic silver salt is not present.

14. A thermally developable photosensitive material according to claim 9, wherein the chalcogen sensitization is tellurium sensitization, selenium sensitization or sulfur sensitization.

15. A thermally developable photosensitive material according to claim 9, wherein the gold sensitization is gold/chalcogen sensitization which is a combination of gold sensitization and chalcogen sensitization, and is selected from the group consisting of gold/sulfur sensitization, gold/tellurium sensitization, gold/sulfur/selenium sensitization, gold/sulfur/tellurium sensitization, gold/selenium/tellurium sensitization, and gold/sulfur/tellurium sensitization.

16. A thermally developable photosensitive material according to claim 9, wherein reduction sensitization is further carried out in addition to the chalcogen sensitization or the gold sensitization.

17. A thermally developable photosensitive material according to claim 9, wherein exposure is conducted with laser beam.

* * * * *